US011850493B2

(12) United States Patent
Bruner et al.

(10) Patent No.: US 11,850,493 B2
(45) **Date of Patent: *Dec. 26, 2023**

(54) BALL TOSSING MACHINE

(71) Applicant: Prosist Sports Equipment Co., LLC, Charleston, SC (US)

(72) Inventors: John Frederick Bruner, Johns Island, SC (US); William C. Cleveland, Charleston, SC (US); Jeffrey Paul Broadrick, Athens, GA (US); David Andrew Hannah, Mauldin, SC (US); Lee Ellis Jarrell, Jr., Easley, SC (US)

(73) Assignee: Prosist Sports Equipment Co., LLC, Charleston, SC (US)

( * ) Notice: Subject to any disclaimer, the term of this patent is extended or adjusted under 35 U.S.C. 154(b) by 42 days.

This patent is subject to a terminal disclaimer.

(21) Appl. No.: 17/815,554

(22) Filed: Jul. 27, 2022

(65) Prior Publication Data

US 2023/0125701 A1 Apr. 27, 2023

Related U.S. Application Data

(63) Continuation of application No. 17/509,717, filed on Oct. 25, 2021, now Pat. No. 11,433,288.

(51) Int. Cl.

| | |
|---|---|
| ***A63B 69/40*** | (2006.01) |
| ***A63B 47/00*** | (2006.01) |
| ***F41B 3/03*** | (2006.01) |

(52) U.S. Cl.

CPC ..... *A63B 69/408* (2013.01)

(58) Field of Classification Search

CPC ..... A63B 69/40; A63B 69/407; A63B 69/408; A63B 47/002; A63B 2047/004; F41B 3/03; F41B 11/53

USPC ..... 124/7, 8, 50, 51.1

See application file for complete search history.

(56) References Cited

U.S. PATENT DOCUMENTS

| | | | | | |
|---|---|---|---|---|---|
| 3,610,223 | A | * | 10/1971 | Green | A63B 69/408 124/16 |
| 3,777,732 | A | * | 12/1973 | Holloway | A63B 69/406 124/78 |
| 3,855,988 | A | * | 12/1974 | Sweeton | A63B 69/409 124/56 |
| 3,913,552 | A | * | 10/1975 | Yarur | A63B 69/406 124/78 |

(Continued)

FOREIGN PATENT DOCUMENTS

| | | | |
|---|---|---|---|
| CN | 105075892 | A | 11/2015 |
| EP | 2 942 087 | A1 | 11/2015 |
| FR | 2433957 | A1 | 3/1980 |

*Primary Examiner* — Alexander R Niconovich

(74) *Attorney, Agent, or Firm* — Womble Bond Dickinson (US) LLP

(57) ABSTRACT

The present invention relates to an improved ball tossing device that is portable and adjustable to accommodate a variety of different balls and lobbing preferences. This may be achieved through various features including some or all of the following: a ball feeding mechanism using a rotating disk with an offset feed channel to deliver balls to the ball tossing queue; a catapult arm that uses a motor/spring mechanism to toss balls in the queue out of the machine; an indexer feature for isolating the ball to be tossed from the other balls in the queue; and adjustable features that allow users to vary ball trajectory of the ball being tossed.

20 Claims, 13 Drawing Sheets

(56) References Cited

U.S. PATENT DOCUMENTS 3,978,841 A * 9/1976 Yarur ..... A63B 69/40 124/51.1
4,094,294 A * 6/1978 Speer ..... F41B 11/53 124/56
4,122,822 A * 10/1978 Scheiwiller ..... A63B 69/408 124/36
4,168,695 A * 9/1979 Haller ..... A63B 69/408 124/16
4,185,608 A * 1/1980 Young ..... A63F 7/2472 124/16
4,207,857 A * 6/1980 Balka, Jr. ..... A63B 69/409 124/56
4,209,003 A * 6/1980 Sainsbury ..... A63B 69/408 124/50
4,269,162 A * 5/1981 Abraham ..... A63B 69/408 221/200
4,273,095 A * 6/1981 Speer ..... A63B 69/409 124/56
4,368,885 A * 1/1983 Katada ..... A63B 69/408 473/436
4,517,953 A * 5/1985 Osaka ..... A63B 69/408 124/17
4,563,999 A * 1/1986 Miehlich ..... A63B 69/40 124/78
4,611,571 A * 9/1986 Tressler ..... A63B 69/408 124/7
4,834,060 A * 5/1989 Greene ..... A63B 69/406 124/78
4,995,371 A * 2/1991 Kuizinas ..... A63B 69/40 124/36
5,067,471 A * 11/1991 Kim ..... A63B 69/407 124/35.1
5,749,797 A * 5/1998 Sunseri ..... A63B 69/407 124/16
5,911,214 A * 6/1999 Andrews ..... A63B 69/408 124/16
6,089,215 A * 7/2000 Morris ..... A63B 69/408 124/16
6,176,230 B1 * 1/2001 Thompson ..... A01K 15/025 124/16
6,637,422 B2 * 10/2003 Wojtkiewicz ..... F41B 4/00 124/78
6,875,136 B2 * 4/2005 Leal ..... A63B 69/0002 124/16
6,877,221 B2 4/2005 Karlsson
7,037,207 B1 5/2006 Bean, Jr.
7,100,594 B2 * 9/2006 Boehner ..... A63B 69/406 124/78
7,445,003 B2 * 11/2008 Smith ..... A63B 69/406 124/78
7,568,478 B2 * 8/2009 Hedberg ..... F41B 11/53 124/51.1
7,610,909 B2 11/2009 Greene, Jr.
7,806,788 B1 * 10/2010 Neuman ..... A63B 69/408 124/78
8,047,190 B2 * 11/2011 Kaakkola ..... F41B 11/57 124/1
8,146,778 B2 * 4/2012 Shen ..... A63B 69/40 221/113
8,287,404 B2 10/2012 Cucjen et al.
8,950,386 B2 * 2/2015 Hedberg ..... F41B 11/53 221/277
8,960,176 B2 2/2015 Baumel
9,067,118 B2 6/2015 Colding-Kristensen
9,320,960 B1 * 4/2016 Ward ..... A01K 15/02
9,446,297 B2 9/2016 Darmon
9,981,174 B1 * 5/2018 Decilveo ..... A63B 69/408
10,252,128 B2 * 4/2019 Lewis ..... A63B 24/0075
10,378,851 B2 * 8/2019 Bei ..... F41A 23/24
10,625,135 B2 * 4/2020 Ward ..... A01K 15/025
11,077,352 B1 * 8/2021 Greene, Jr. ..... A63B 69/406
11,235,223 B1 * 2/2022 Fernandez ..... A63B 43/00
2005/0172943 A1 8/2005 Cucjen et al.
2006/0137672 A1 6/2006 Smith
2006/0254734 A1 11/2006 Hannay et al.
2008/0173288 A1 7/2008 Greene, Jr.
2009/0229590 A1 * 9/2009 Tan ..... A63B 69/407 124/51.1
2010/0252015 A1 10/2010 Cucjen et al.
2011/0303207 A1 * 12/2011 Shober ..... A63B 69/408 124/54
2012/0103317 A1 5/2012 Baumel
2015/0321059 A1 * 11/2015 Hussey ..... F41B 7/00 119/707
2019/0247733 A1 * 8/2019 Ye ..... A63B 69/406
2020/0197782 A1 6/2020 Abdelmoneum et al.

* cited by examiner

BALL TOSSING MACHINE

CROSS-REFERENCE TO RELATED APPLICATIONS

This present application is a continuation of U.S. patent application Ser. No. 17/509,717, which was filed on Oct. 25, 2021, and entitled "Ball Tossing Machine," and which is hereby incorporated by reference in its entirety

FIELD OF THE INVENTION

The present invention relates generally to an improved ball tossing device. More specifically, a ball tossing device that is portable and adjustable to accommodate a variety of different balls and tossing preferences.

BACKGROUND

Several machines for tossing balls have been proposed throughout the years, many directed to tennis balls. Most of these devices focus on a machine that attempts to simulate "real match conditions." For example, several existing ball machines include features to generate different spins, speeds, and/or locations of the ball being tossed. These devices may also include various electrical components for storing a "pattern" of ball tosses, often designed to simulate a tennis match.

Development of these machines has often focused on this "match simulation" goal, with a particular emphasis on the adult tennis game. Over the years, tennis matches have increasingly been characterized by faster pace shots and additional ball spin. As a result, these devices utilize high speed, opposing rotational wheels to accommodate these demands. The speed in these rotating wheels may be adjusted, at times asynchronously, to allow for the various different spins often seen in tennis matches, such as top spin, back spin, slice spin, etc. In addition, microprocessors have become more pervasive and allow for more programing flexibility. Ball machines increasingly utilize these microprocessors to design complex patterns or even randomized patterns, which may require the machine to dynamically change ball tosses between each toss.

As a result of these design objectives and developments, ball machine technology has progressed in several ways but certain deficiencies still persist, particularly for applications not directed to this "match simulation" goal. For example, existing machines are directed to tossing a standard tennis ball. They are not designed to accommodate different sized and different pressured tennis balls that may be used in training youth players. Existing ball machines further fail to include mechanisms that reliably and predictably direct balls through the machine. In addition, two-rotating wheel mechanisms result in complex, heavy devices that are often relatively expensive.

BRIEF SUMMARY OF EXAMPLE EMBODIMENTS

Thus, there exists a need for an improved, easy to use, ball machine. Preferably one able to accommodate multiple different ball sizes and pressures with a single device, and one that services players of all ages and skill levels.

Some example implementations provide a ball tossing device comprising: a hopper configured to hold one or more balls, the hopper comprising one or more sides and a base; a disk located proximate the base of the hopper and configured to rotate about a rotation axis; a feed channel located in the disk, the feed channel extending between an upper opening defined in the disk and a lower opening defined in the disk; and a catapult arm comprising a hammer portion configured to rotate about a pivot axis, wherein the lower opening of the disk is substantially aligned with the rotation axis and the upper opening of the disk is offset with respect to the rotation axis, such that when the disk is rotated about the rotation axis, the upper opening rotates at a substantially fixed distance from the rotation axis and the lower opening remains in a substantially constant location relative to the rotation axis, wherein the feed channel is configured to receive at least one of the one or more balls from the hopper via the upper opening, and wherein the catapult arm is configured such that when the hammer portion rotates about the pivot axis, the catapult arm strikes the ball received through the feed channel.

In some example implementations of the ball tossing device of any example implementation, or any combination of any preceding example implementation, wherein the disk includes an upper surface that defines a plane that is angled in relation to a plane defined by ground.

In some example implementations of the ball tossing device of any example implementation, or any combination of any preceding example implementation, wherein the upper opening of the disk includes a scalloped portion configured to agitate the one or more balls located within the hopper when the disk is rotated about the rotation axis.

In some example implementations of the ball tossing device of any example implementation, or any combination of any preceding example implementation, wherein the feed channel contains at least one bend between the upper opening and the lower opening.

In some example implementations of the ball tossing device of any example implementation, or any combination of any preceding example implementation, further including a disk motor configured to rotate the disk, wherein the disk motor is located a distance away from the disk.

In some example implementations of the ball tossing device of any example implementation, or any combination of any preceding example implementation, further including a housing; a catapult motor located in the housing and coupled to the catapult arm, wherein the catapult motor is configured to rotate the catapult arm about the pivot axis; and a catapult spring having a first end and a second end, wherein the first end is attached to the catapult arm at a radial distance from the pivot axis, and the second end is coupled to the housing at an anchor location.

In some example implementations of the ball tossing device of any example implementation, or any combination of any preceding example implementation, further including two or more anchor positions, wherein the second end of the catapult spring is configured to be coupled to any of the two or more anchor positions and at least one anchor position results in a different spring force than at least one other anchor position.

In some example implementations of the ball tossing device of any example implementation, or any combination of any preceding example implementation, wherein each anchor position corresponds to a different tossing force, and wherein a visual indicator is provided at one or more of the anchor positions, thus providing an indication of the tossing force provided at the given anchor position.

In some example implementations of the ball tossing device of any example implementation, or any combination of any preceding example implementation, further including a catapult arm path defined by a rotational path of the hammer portion of the catapult arm as it rotates about the pivot axis; and a platform capable of receiving one or more balls from the feed channel of the disk, wherein the platform is positioned proximate the catapult arm path such that a ball received on the platform is positioned within at least a portion of the catapult arm path.

In some example implementations of the ball tossing device of any example implementation, or any combination of any preceding example implementation, wherein the platform is adjustable between two or more platform positions, and wherein each platform position represents a different location of the platform relative to the catapult arm path.

In some example implementations of the ball tossing device of any example implementation, or any combination of any preceding example implementation, wherein each platform position corresponds to a desired launch position for a ball being tossed on the platform, and a visual indicator is provided proximate at least one of the one or more platform positions providing an indication of the launch position for the platform position.

In some example implementations of the ball tossing device of any example implementation, or any combination of any preceding example implementation, the further including: a ramp comprising an upper end and a lower end, wherein the upper end is located proximate the lower opening of the disk and is capable of receiving a ball from the feed channel, and the lower end is located proximate the platform; a ball path defined as the path a ball travels from the upper end of the ramp to the lower end of the ramp and onto the platform; and an indexer tab proximate the lower end of the ramp, wherein the indexer tab is configured to selectively move between an actuated position, where at least a first portion of the indexer tab is located within the ball path at a first location, and an unactuated position, where a second portion of the indexer tab is located within the ball path at a second location.

In some example implementations of the ball tossing device of any example implementation, or any combination of any preceding example implementation, further including a lever arm configured to move the indexer tab between the actuated position and unactuated position, wherein the lever arm is configured to engage with the catapult arm when the catapult arm rotates about the pivot axis such that when the lever arm engages with the catapult arm a indexer actuator moves the indexer tab from an actuated position to an unactuated position.

Some example implementations a ball tossing machine comprising: a housing structure; a ball hopper coupled to the housing structure configured to hold one or more balls to be tossed; a disk coupled to the housing structure configured to rotate about a rotation axis; a feed channel located in the disk, the feed channel extending between an upper opening defined in the disk and a lower opening defined in the disk; a catapult arm comprising a hammer portion configured to rotate about a pivot axis within the housing, wherein the rotation of the hammer portion about the pivot axis defines a catapult arm path; and a platform coupled to the housing, wherein the platform is positioned proximate the catapult arm path; wherein the lower opening of the disk is substantially aligned with the rotation axis and the upper opening of the disk is offset with respect to the rotation axis, such that when the disk is rotated about the rotation axis, the upper opening rotates at a substantially fixed radius from the rotation axis and the lower opening remains in a substantially constant location, wherein the feed channel is configured to receive at least one of the one or more balls from the hopper via the upper opening, and wherein the platform is configured to receive through the feed channel at least one of the one or more balls; and wherein the catapult arm is configured such that when the hammer portion rotates about the pivot axis, the catapult arm strikes the ball located on the platform.

In some example implementations of the ball tossing machine of any example implementation, or any combination of any preceding example implementation, wherein the upper surface of the disk defines a plane that is angled in relation to a plane defined by the ground.

In some example implementations of the ball tossing machine of any example implementation, or any combination of any preceding example implementation, wherein the feed channel opening contains at least one bend between the upper opening and the lower opening.

In some example implementations of the ball tossing machine of any example implementation, or any combination of any preceding example implementation, further including a disk motor configured to rotate the disk, wherein the disk motor is located a distance away from the disk, and the disk motor connects to the disk via a motor belt.

In some example implementations of the ball tossing machine of any example implementation, or any combination of any preceding example implementation, further comprising: a catapult motor located in the housing and coupled to the catapult arm, wherein the catapult motor is configured to rotate the catapult arm about the pivot point; and a catapult spring having a first end and a second end, wherein the first end is attached to the catapult arm at a radial distance from the pivot axis and the second end is coupled to the housing at an anchor position.

In some example implementations of the ball tossing machine of any example implementation, or any combination of any preceding example implementation, further including two or more anchor positions, wherein the second end of the spring may be coupled to any of the two or more anchor positions and at least one anchor position results in a different spring force than at least one other anchor position.

In some example implementations of the ball tossing machine of any example implementation, or any combination of any preceding example implementation, wherein the ball hopper comprises one or more removable panels with at least one ridge located on a lower portion of at least one of the removable panels, wherein the at least one ridge is configured to agitate the one or more balls located within the hopper when the disk is rotated about the rotation axis.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
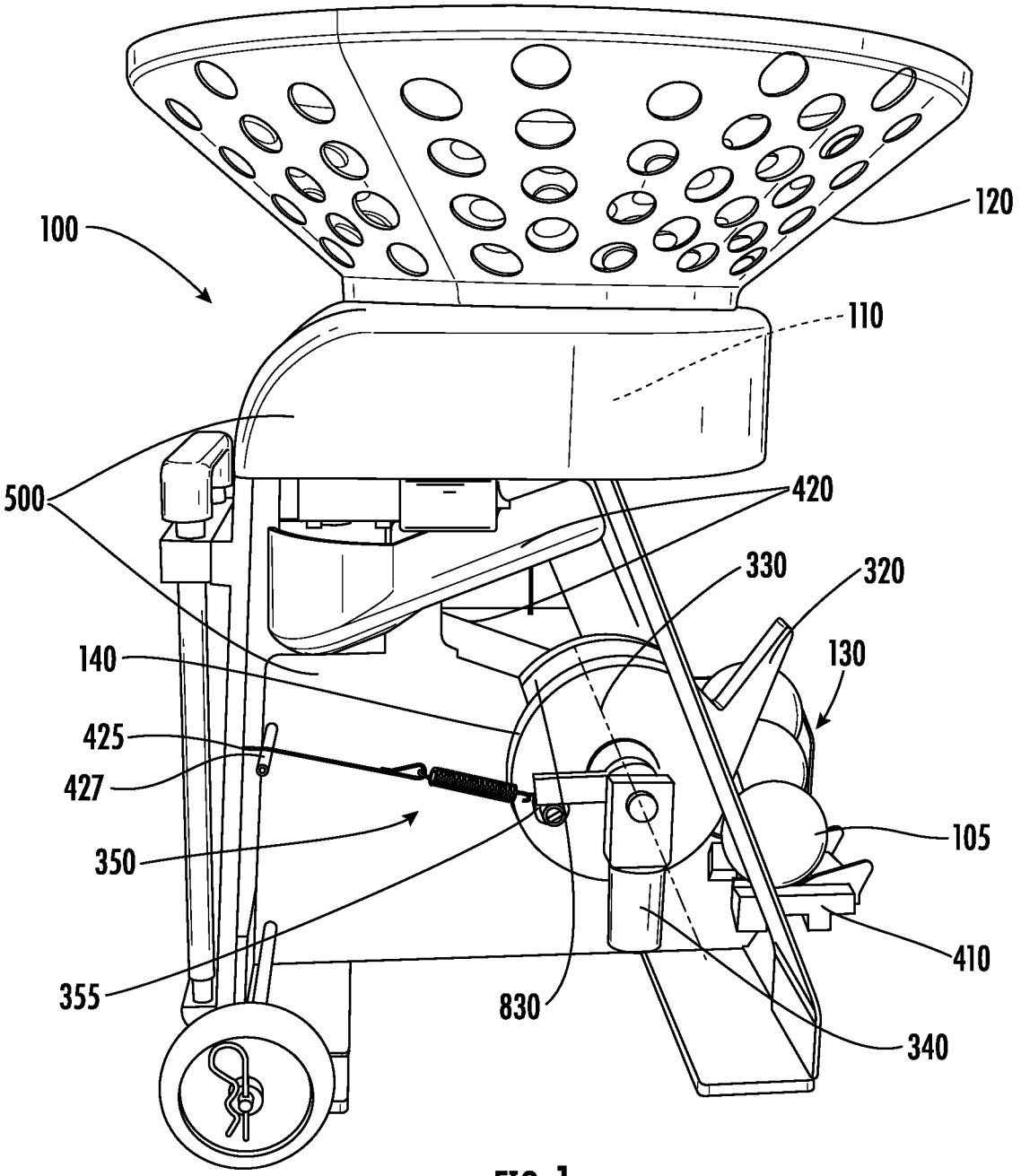
FIG. 1 is a side view illustration of a ball tossing device, according to an example embodiment of the present invention.

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Some components and associated systems are not shown in one or more of the figures for clarity and to facilitate explanation of embodiments of the present invention.

As used herein, the terms "bottom," "top," "upper," "lower," "interior," "exterior," and/or similar terms are used for ease of explanation and refer generally to the position of certain components or portions of the components of embodiments of the described invention in the installed configuration (e.g., in an operational configuration, such as located on a tennis court). It is understood that such terms are not used in any absolute sense. Embodiments discussed in this application are equally applicable to multiple uses, including tennis balls, baseballs, softballs, whiffle balls, pickle balls, basketballs, footballs, and others balls or objects. Moreover, although the examples used below refer primarily to features used on a ball tossing machine, embodiments of the present invention may further be applicable to tossing devices for other applications and in other contexts (e.g., pet toys, kids games, etc.).

Example embodiments of the present invention relate to an improved ball tossing device that is portable and adjustable to accommodate a variety of different balls and lobbing preferences. This may be achieved through various features including some or all of the following: (1) a ball feeding mechanism using a rotating disk with a feed channel configured to deliver one or more balls from a ball hopper to a ball tossing queue; (2) a catapulting arm that uses a motor/spring mechanism to toss balls in the queue out of the machine; (3) an indexer feature for isolating a ball to be tossed from other balls in the queue; and (4) adjustable features that allow users to vary the ball trajectory and speed of the balls being tossed.

FIG. 1 shows an example embodiment of the present invention. As shown in the figure, the ball tossing device 100 comprises a housing 500, a ball hopper 120 located on top of the housing 500, and a ball feeding mechanism 110 (see also FIGS. 3A and 3B) configured to receive balls 105 from the ball hopper 120. In the depicted embodiment, the ball feeding mechanism directs the received balls 105 via a feed channel 210 (see FIGS. 3A and 3B) located in the ball feeding mechanism 110 onto a ball ramp 420 (see also FIG. 5), which directs the balls 105 to a ball platform 410. In depicted embodiment, multiple balls 105 are located on the ball ramp 420 and these balls form a ball queue 130.

The depicted embodiment also includes a catapult arm 140 that includes a hammer portion 320 configured to rotate about a pivot axis 330. In the depicted embodiment, the catapult arm 140 is further coupled to a catapult motor 340 via a motor cam 342 and a catapult spring 350 that powers the rotation of the catapult arm 140 about the pivot axis 330 relative to the housing 500. Although other configurations are possible, in the depicted embodiment, the housing 500 supports the catapult motor 340 and/or the catapult arm 140. In the depicted embodiment, the catapult spring 350 is coupled to the housing 500 as described in more detail below. The rotation of the catapult arm 140 defines a catapult arm path 145, through which the catapult arm 140 engages with a ball 105 when the ball 105 is on the ball platform 410. This engagement causes the ball 105 to be tossed out of the device 100.

Figure 2A:
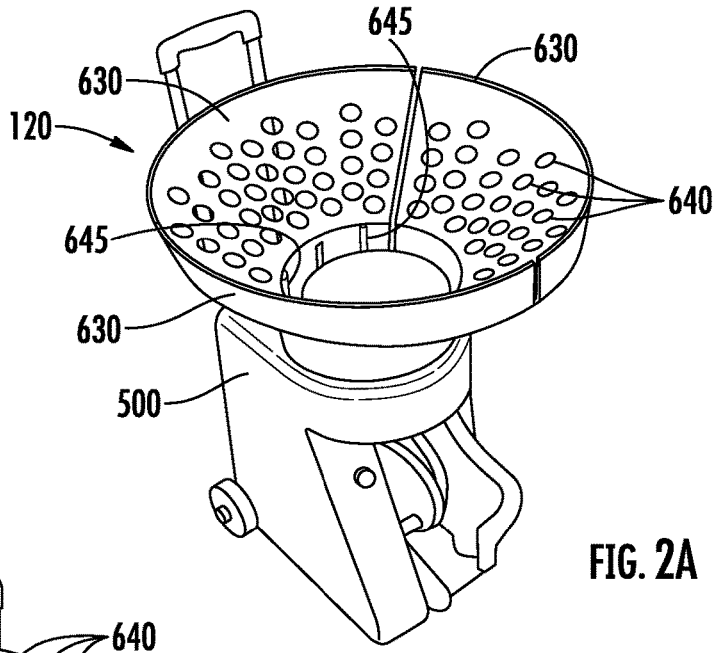
FIG. 2A is a perspective view of a ball tossing device, according to an example embodiment of the present invention.
Figure 2B:
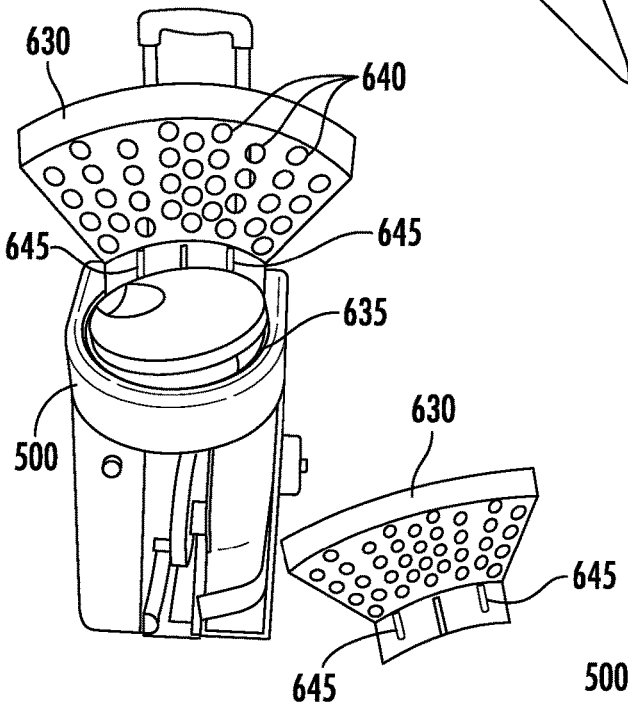
FIG. 2B is another perspective view of a ball tossing device, according to an example embodiment of the present invention.
Figure 2C:
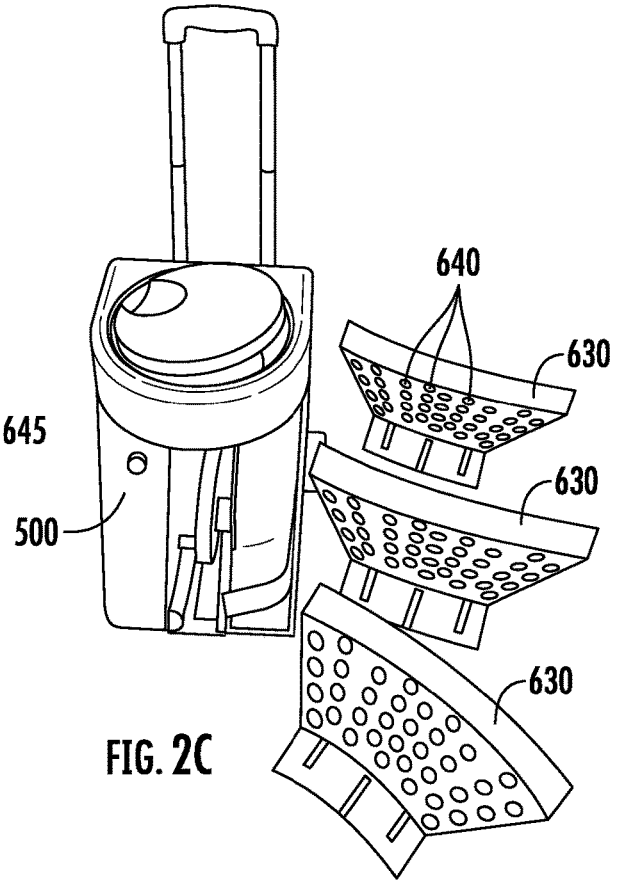
FIG. 2C is another perspective view of a ball tossing device, according to an example embodiment of the present invention.

FIGS. 2A-E show example embodiments of ball hopper 120. In particular, FIGS. 2A-C show an embodiment that utilizes removable panels to form the ball hopper 120. In this depicted embodiment, the ball hopper 120 comprises removable hopper panels 630. In this embodiment, three hopper panels 630 are arranged circumferentially around the upper surface of the housing 500, with each hopper panel 630 forming a portion of a frustro-conical ball hopper 120 extending from the top of the housing 500. In this embodiment, the hopper is sized to receive over a hundred standard yellow tennis balls. In the depicted embodiment, the hopper panels 630 do not overlap, but instead are arranged adjacent to one another to form the ball hopper 120. In some embodiments, more or less hopper panels may be used, and in some embodiments, the hopper panels may overlap to some degree. In some embodiments, the hopper panels may form a different shaped hopper.

In the embodiment depicted in FIGS. 2A-C, the upper surface of the housing 500 includes a channel 635 that runs circumferentially. In this embodiment, each hopper panel 630 engages with the channel 635 to form the frustro-conical hopper extending from the top of the housing 500 (see FIG. 2A). In some embodiments, the channel 635 is deep enough to provide lateral support to each hopper panel 630. Some embodiments may include additional fasteners (e.g, clips, screws, glue, tap, velcro, etc.) or other features to attach the hopper panels 630 to the channel 635 and/or the housing 500 directly. In the depicted embodiment, the hopper panels 630 are removable. In some embodiments, the ball hopper 120 and/or hopper panels 630 are fixed to the housing 500. In the depicted embodiment, the hopper panels 630 are made from three similar parts that nest together, which in some embodiments allows for efficient storage of these panels 630. The hopper panels 630 in the depicted embodiment further include a number of openings 640. Although in various embodiments the number, shape, and/or size of the openings may vary, in the depicted embodiment the openings comprise substantially circular holes having a diameter of approximately 2 inches. These openings 640 allow users to see balls located within the ball hopper to determine if any balls remain in the device and/or to estimate a number of balls remaining in the device. In other embodiments, there need not be any openings and/or the panels may be made of a transparent or semi-transparent material. The depicted embodiments also include one or more ridges 645 located on an inner surface of the hopper panels 630. In the depicted embodiments these ridges 645 are located on a lower portion of the hopper panels 630. In some embodiments, when the hopper is in the assembled configuration, these ridges may engage with balls within the hopper, moving and/or agitating these balls. In some embodiments these ridges facilitate moving the balls within the hopper into the opening within the rotating disk. Other configurations and locations for these ridges are contemplated within the scope of the disclosure herein.

Figure 2E:
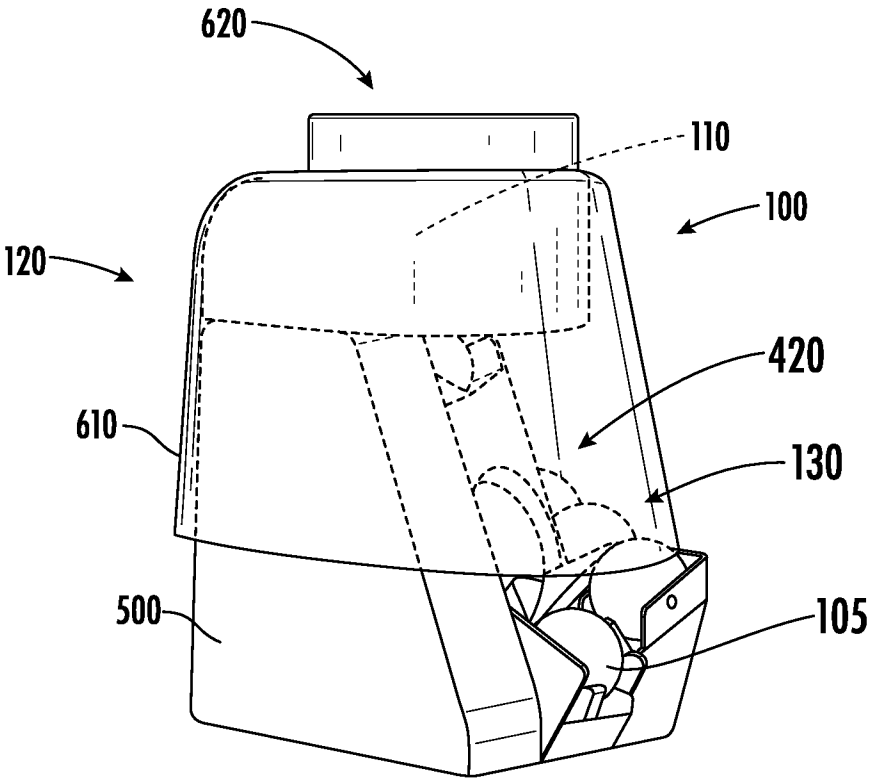
FIG. 2E is another perspective view of a ball tossing device, according to an example embodiment of the present invention.
Figure 2D:
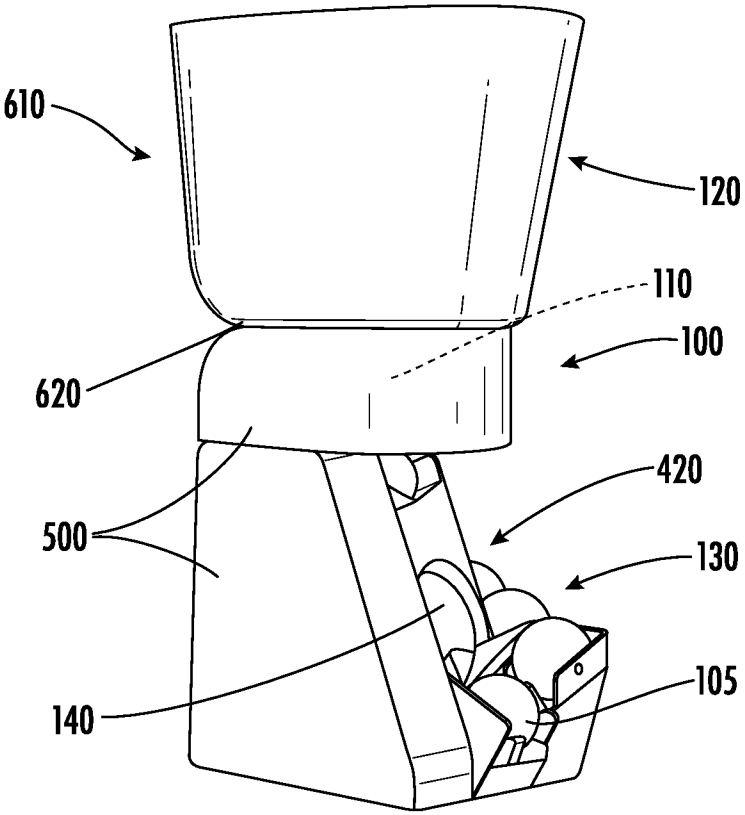
FIG. 2D is another perspective view of a ball tossing device, according to an example embodiment of the present invention.

FIGS. 2D and 2E show an illustration of another example embodiment of ball hopper 120 in two different configurations. In various embodiments, the ball hopper may be capable of holding balls of any size and any number. For example, in some embodiments the ball hopper may hold 20, 40, 80, 100, or more balls. The ball hopper of various embodiments may further hold different types of balls. In various embodiments, the ball hopper may include one or more sides and a base, and the sides and the base may be made of walls, e.g., side walls and base walls. In the depicted embodiment, the side 610 of the ball hopper 120 includes a side wall that defines a hollow interior. The side wall of the depicted embodiment extends outwardly and upwardly from the base 620, which comprises a substantially cylindrical base wall that also defines a hollow interior. In some embodiments, the sides and the base share a common structure such that a side wall may form a part or all of the base, or conversely, a base wall may form a part or all of the side. In other embodiments, the side and the base may comprise separate walls. For example, in some embodiments, the side and base may comprise separate parts. In still other embodiments, other features or aspects of the device may serve as some or all of the sides and/or the base. For example, in some embodiments, the ball feeding mechanism may form some or all of the base of the ball hopper. In another example, the housing may also form part of the ball hopper.

Although in some embodiments the ball hopper may be integral with a portion of the ball tossing machine (such as, for example, the housing), in the depicted embodiment, the ball hopper 120 is configured to be detachable from the remaining portions of the ball tossing device 100. In addition, the ball hopper 120 of the depicted embodiment is configured to be attached to the ball tossing device 100 in multiple orientations. In particular, as shown in FIG. 2D, the ball hopper 120 may be configured to attach to the housing 500 in an upright orientation, with the base portion 620 connected to the housing 500 and the side portion 610 extending away from the housing 500. In this orientation, the ball hopper 120 is configured to hold multiple balls 105, and to feed balls 105 into the ball feeding mechanism 110. As shown in FIG. 2E, this same ball hopper 120 may also be configured to attach in a reverse or upside-down orientation, such that the side portion 610 overlaps at least a portion of the housing 500, and the base portion 620 is located in the uppermost position. Such a configuration may be beneficial for transporting or storing the ball tossing device 100. In such a manner, in some embodiments, at least a portion of the side of the ball hopper may have a shape configured to correspond with at least a portion of the shape of the housing in a reverse or upside-down orientation.

In various embodiments, the ball hopper may be made of any suitable material, or any combination of suitable materials, including, for example, various metal and/or plastic materials.

Returning to FIG. 1, the ball feeding mechanism 110 of the depicted embodiment is located below the ball hopper 120 and may be configured to receive balls 105 from the ball hopper 120, and direct the balls 105 in an orderly fashion to the catapult arm 140 for tossing. FIG. 3D shows an example illustration of the location of the ball feeding mechanism 110 relative to the ball hopper 120.

Figure 3A:
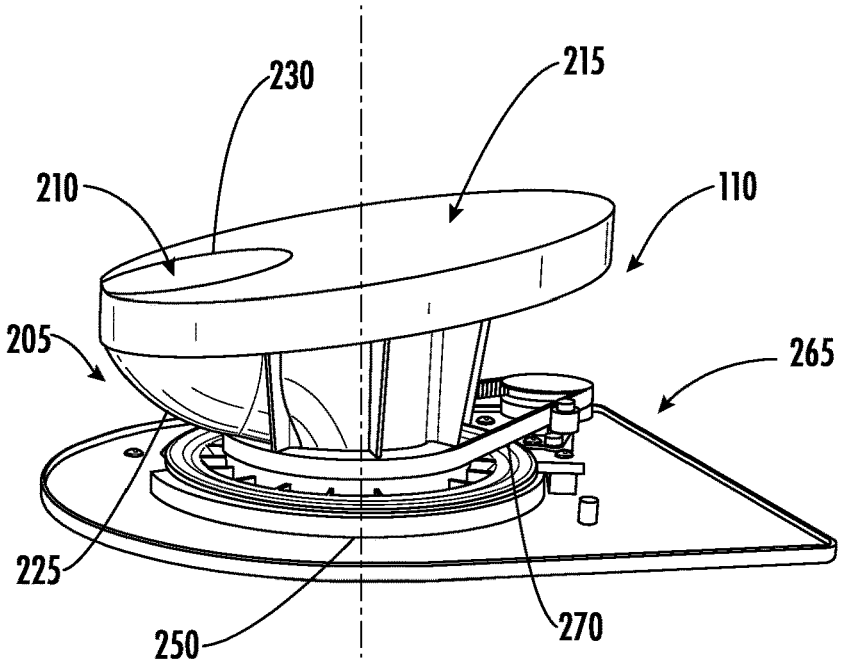
FIG. 3A is a perspective view of a ball feeding mechanism, according to an example embodiment of the present invention.
Figure 3B:
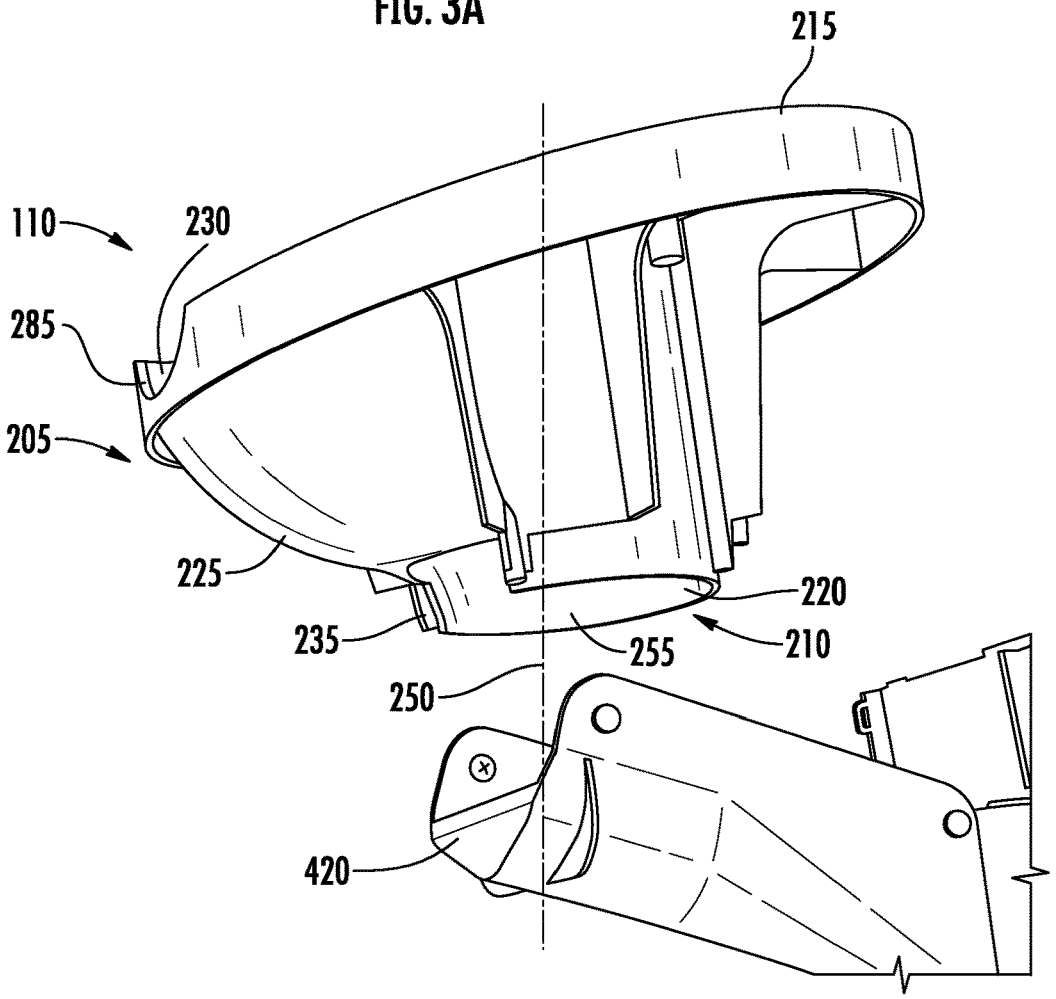
FIG. 3B is another perspective view of a ball feeding mechanism, according to an example embodiment of the present invention.
Figure 3C:
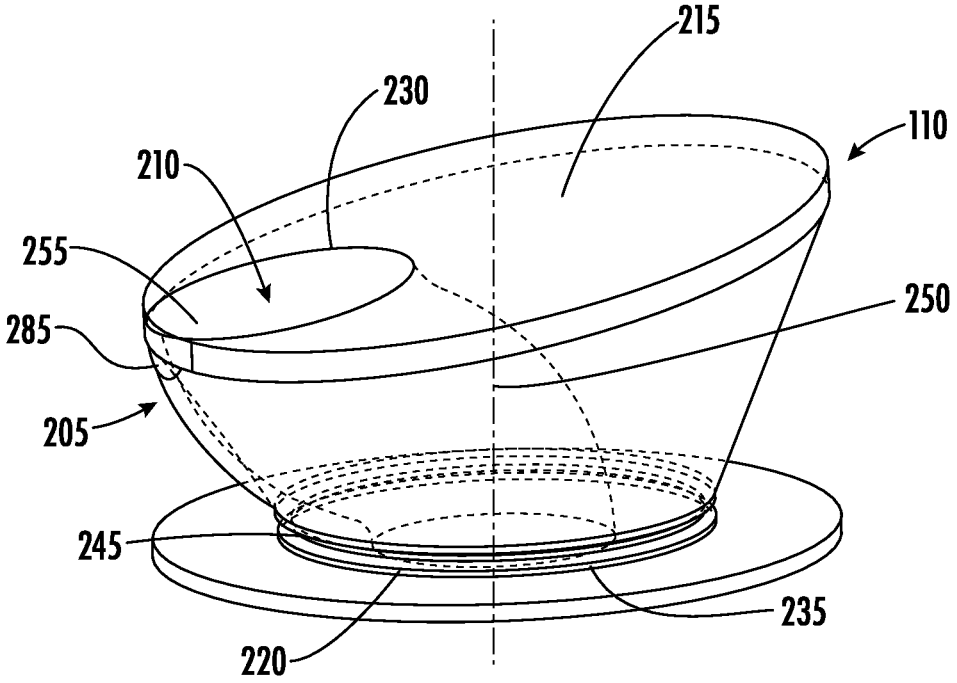
FIG. 3C is another perspective view of a ball feeding mechanism, according to an example embodiment of the present invention.
Figure 3D:
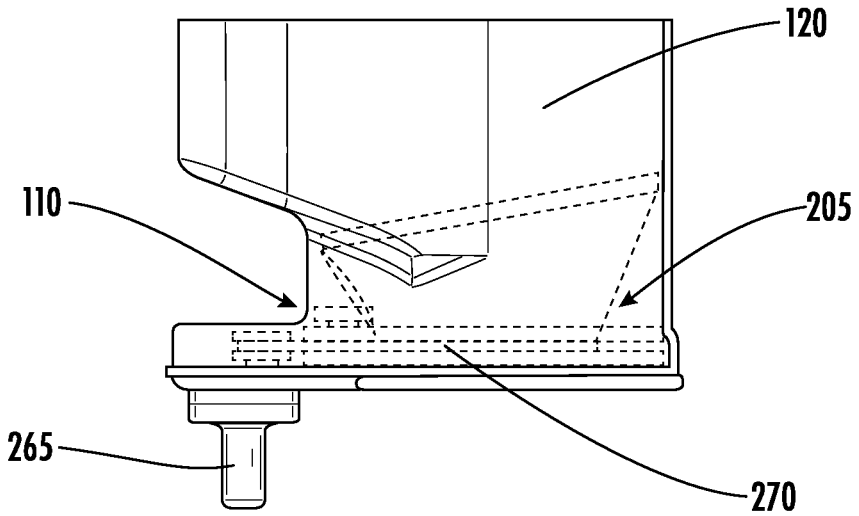
FIG. 3D is a side view of a ball feed mechanism and a ball hopper, according to an example embodiment of the present invention.

FIGS. 3A-C show example illustrations of embodiments of the ball feeding mechanism 110. In the depicted embodiment, the ball feeding mechanism 110 comprises a rotating disk 205 that includes a feed channel 210. The rotating disk 205 comprises an upper surface 215, an outer wall 225, and may also include a lower surface 220. The feed channel 210 forms a channel that extends between an upper opening 230 of the rotating disk 205 to a lower opening 235 the rotating disk 205. FIGS. 3A and 3B show an illustration of an embodiment of rotating disk 205 where the outer wall 225 has a curved shape and converges to form the lower opening 230 (shown in FIG. 3B). FIG. 3C shows an illustration of an embodiment of rotating disk 205 that includes a planar lower surface 220 with a lower opening 230 defined in the lower surface 220. In both of these depicted embodiments, the upper opening 230 is defined in the upper surface 215. Other configurations and structures for the rotating disk are contemplated within the scope of this invention.

In some embodiments, the upper surface of the rotating disk may define a plane substantially parallel to a plane defined by the ground. In the depicted embodiment, however, the plane defined by the upper surface 215 is slanted or angled with respect to the plane defined by the ground. Example illustrations of angled embodiments of the upper surface 215 of the rotating disk 205 are shown in FIGS. 3A-D.

In the depicted embodiment, the rotating disk 205 is an elongated disk. For example, the rotating disk 205 includes a height defined as the distance vertically between the upper surface and the bottom of rotating disk 205. In some embodiments, this height is substantially the same or greater than the diameter of a ball 105 being tossed. In some embodiments, where the upper surface 215 is angled or otherwise not parallel with the ground and thus the height of the rotating disk 205 varies, the lowest height of the rotating disk may be substantially the same or greater than the diameter of a ball 105 being tossed. In some embodiments, the outer wall 225 may also be curved. For example, in the embodiment depicted in FIGS. 3A and 3B the outer wall is curved and converges at the lower opening 235 (shown in FIG. 3B). In the embodiment depicted in FIG. 3C the rotating disk 205 has a substantially frusto-conical shape. Other configurations and arrangements are also contemplated for the outer wall 225 within the scope of this invention. For example, in some embodiments alignment features may also be included on the outer wall that may direct the rotation of the rotating disk along a certain pattern. In various embodiments, a variety of different alignment features may be used, including, for example, male and/or female pins and grooves.

In the depicted embodiment, a rotation axis 250 defines an axis that runs substantially vertically through the center of rotation for the rotating disk 205. As shown in FIG. 3A-C, the upper opening 230 of the depicted embodiment is offset from lower opening 235 relative to the rotation axis 250. In particular, the upper opening 230 of the depicted embodiment is offset radially from the rotation axis 250 and the lower opening 235 is substantially aligned with the rotation axis 250. As a result, when the rotating disk 205 is rotated about the rotation axis 250, the upper opening 230 remains at a substantially fixed distance from the rotation axis 250, and the lower opening 235 remains at a substantially constant location. FIG. 3B also shows an illustration of the upper portion of the ball ramp 420, and as shown, in some embodiments, the rotational axis 250 and the lower opening 230 align vertically with the ball ramp 420. This allows the balls 105 to be fed from the ball hopper 120 through the feed channel 210 to the same location on the ball ramp 420 regardless of the rotational position of the rotating disk 205. This configuration may be helpful to void pinch points in the ball feeding path, and thus limit or eliminate ball jams.

As also shown in FIGS. 3A-C, the feed channel 210 of the depicted embodiment is substantially hollow allowing balls 105 to be directed from the ball hopper 120 through the rotating disk 205. The feed channel 210 of the depicted embodiment also comprises an inner channel wall 255 that extends from the upper opening 230 to the lower opening 235. In some embodiments, the feed channel 210 is sized to accommodate the largest ball that may be tossed by the device (e.g., red tennis training balls, etc.), which in some embodiments, allows the device to feed multiple different types of balls and ball sizes without any adjustments and/or ball jams. In some embodiments, the upper opening may be sized larger than the lower opening. In such embodiments, the feed channel may vary in channel size between the upper opening and the lower opening. In some embodiments, the feed channel may have a substantially frusto-conical shape between the upper opening and the lower opening. In some embodiments, the feed channel may include a bend between the upper opening and the lower opening. In some embodiments, the upper surface of the rotating disk may include two or more upper openings that feed into a single lower opening. In such embodiments, the feed channel may include branches between the two or more upper openings and the lower opening.

In some embodiments, the upper opening may include features that allow a user to vary the size of the upper opening. For example, the upper opening may include an adjustable opening feature (e.g., tabs, screens, sliding plate (s), etc.). In some embodiments, these adjustable opening features may be able to move between different predetermined positions, for example, the upper opening may have predetermined opening sizes corresponding to different sized balls such as different types tennis balls (e.g., red, orange, green, standard) or even different types of balls (e.g., baseballs, pickleballs, softballs, tennis balls, etc.) such that only balls that have a designated size or size range pass through the upper opening. In some embodiments, the device may include adjustment opening features in the feed channel and/or the lower opening. In embodiments that include more than one upper opening, each upper opening may be sized differently and may be configured to close. In some embodiments, the device may also include visual indicators, such as colors and/or indicia, including, for example, drawings, symbols, text, numbers, etc., to indicate a size or type ball associated with a particular adjustable feature.

In some embodiments, the rotating disk includes a scalloped portion 285 as shown in FIG. 3B. In the depicted embodiment, the scalloped portion 285 is shown as a depressed crescent shaped edge, and the scalloped portion 285 is located as part of the upper opening 230. The scalloped portion may engage with balls located within the ball hopper, moving and/or agitating them. In some embodiments, this movement and/or agitation facilities the balls entering the upper opening, and allows for a better flow of balls through the device. Other locations and/or configurations are contemplated for the scalloped portion, including a portion that protrudes vertically and provides similar functionality.

In the depicted embodiment, as shown in FIG. 3D, the ball tossing device 100 further includes a disk motor 265 configured to rotate the rotating disk 205. In the depicted embodiment, the disk motor 265 is located a distance away from the rotating disk 205 and is coupled to the rotating disk 205. In various embodiments, the disk motor may be coupled to the rotating disk in a variety of different ways (e.g., belts, gears, chains, etc.). In some embodiments, the disk motor may be located a distance away from the lower opening of the rotating disk such that the disk motor does not impede the path of a ball traveling through the feed channel.

As illustrated in FIG. 3A, the disk motor 265 of the depicted embodiment is attached to the rotating disk 205 using a disk belt 270.

Figure 3E:
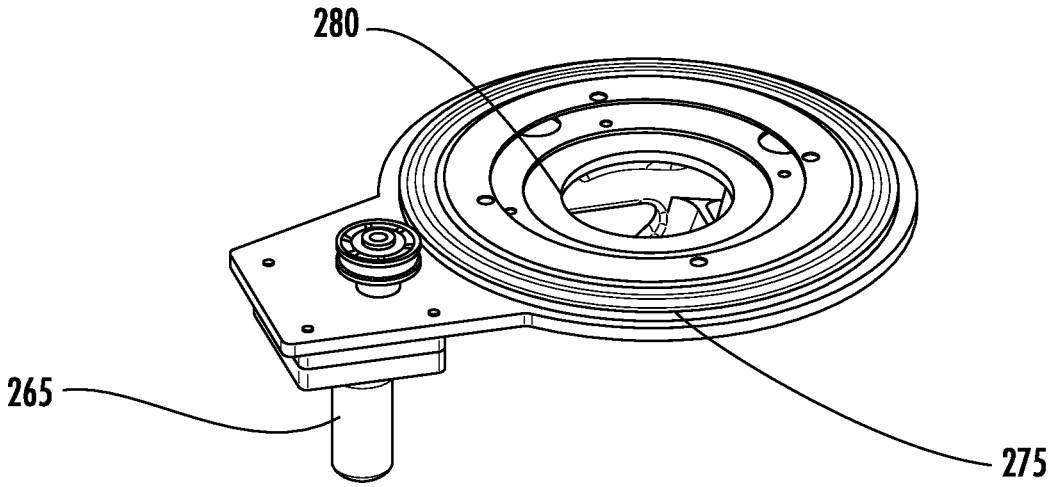
FIG. 3E is a perspective view of a rotating tray, according to an example embodiment of the present invention.

In the depicted embodiments as shown in FIG. 3E, the device 100 further includes a rotating tray 275, which in some embodiments may be a "lazy Susan" like device. In the depicted embodiment, the rotating tray 275 supports the rotating disk 205 and allows the rotating disk 205 to rotate about the rotation axis 250. In the depicted embodiment, the rotating tray 275 includes an opening 280 that is located in the center of the tray 275. Although other embodiments may differ, in the depicted embodiment, the opening 280 substantially aligns with the lower opening 235 in the rotating disk 205.

FIGS. 4A-E show example illustrations of a catapult arm according to example embodiments of the present invention. In the depicted embodiments, the catapult arm 140 is configured to toss a ball 105 out of the machine at a controlled trajectory. The mechanism utilizes a catapult motor 340 and catapult spring 350 to drive a hammer portion 320 about a pivot axis 330. In the depicted embodiments, the catapult motor 340 provides consistent rotational motion and power to load the catapult spring 350 at a certain rotational position. Once the catapult spring 350 is loaded and the catapult arm 140 reaches the appropriate unloading position, the force loaded in the catapult spring 350 rotationally drives the catapult arm 140 to hammer a ball 105 located on the ball platform 410, tossing the ball 105 out of the device 100.

Figure 4A:
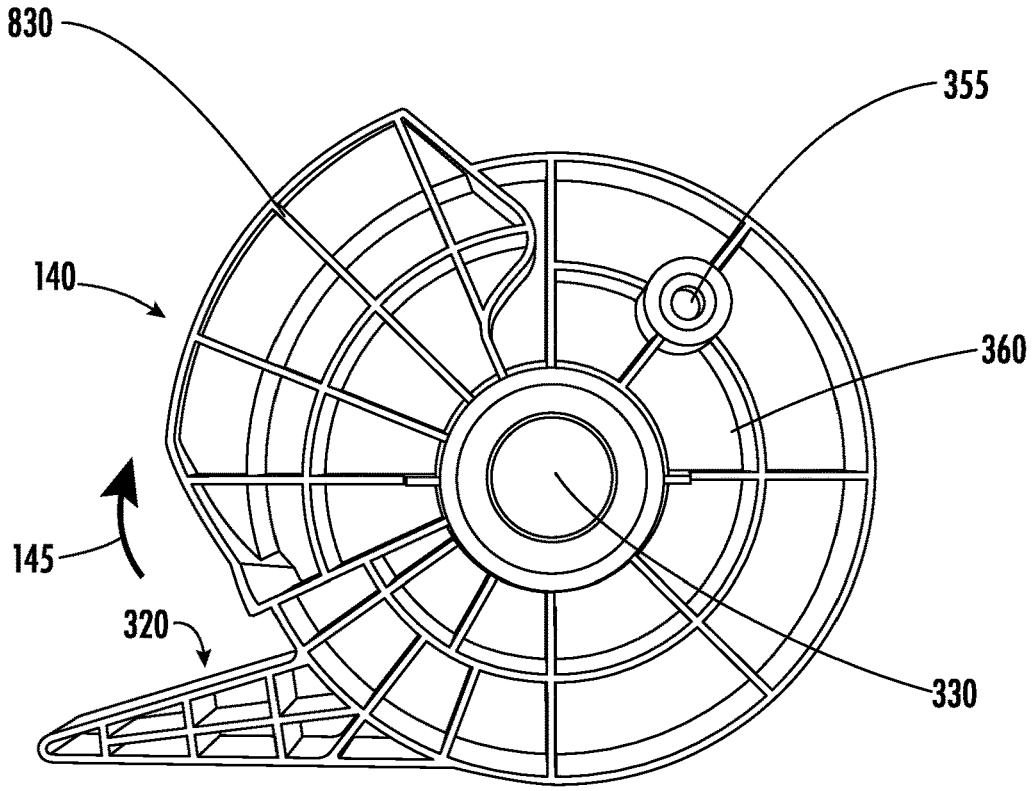
FIG. 4A is a side view of a catapult mechanism, according to an example embodiment of the present invention.
Figure 4B:
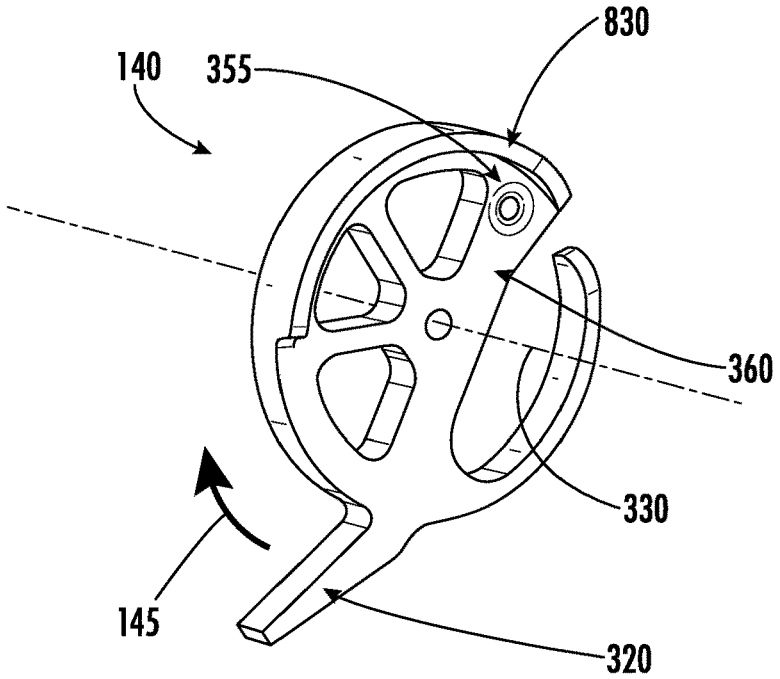
FIG. 4B is a perspective view of a catapult mechanism, according to an example embodiment of the present invention.

As shown in FIGS. 4A and 4B, the catapult arm 140 of the depicted embodiments includes a hammer portion 320 and a pivot axis 330 and defines a catapult arm path 145. The path 145 is defined as the path through which the hammer portion 320 rotates when the catapult arm 140 rotates about the pivot axis 330. The catapult arm 140 of the depicted embodiments also includes a catapult arm surface 360 extending around the pivot axis 330. In some examples, the catapult arm surface 360 may form a wheel, and the hammer portion 320 may extend from the catapult arm surface 360. In the depicted embodiments, the catapult arm 140 also includes a spring attachment feature 355 that attaches to one end, potentially a first end, of the catapult spring 350. In the depicted embodiments, the spring attachment feature 355 is located on catapult arm surface 360. FIG. 4B shows another embodiment of a catapult arm 140 that may be used. Other locations and configurations are also contemplated within the scope of this invention.

Figure 4C:
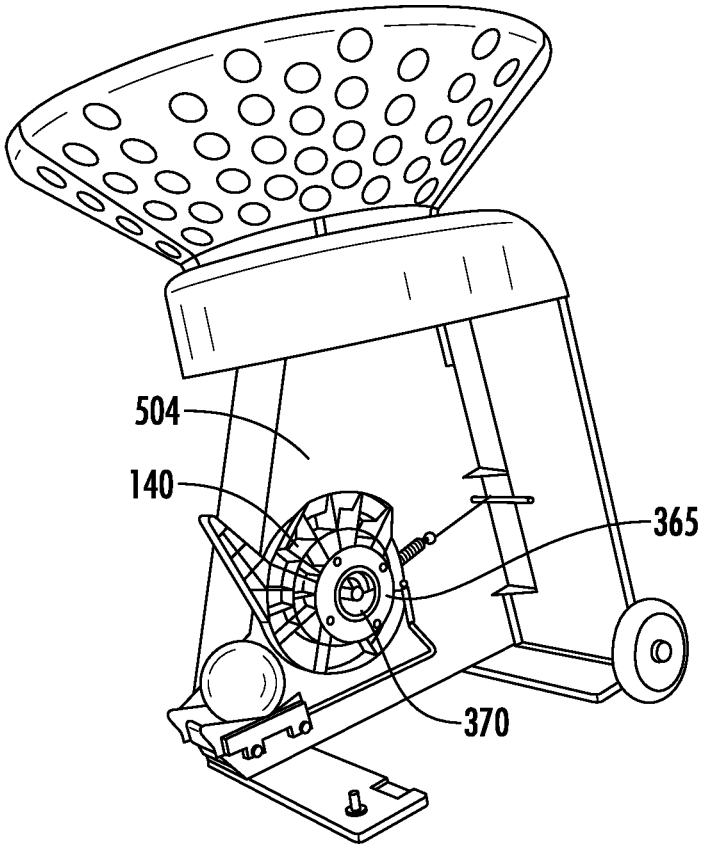
FIG. 4C is a perspective view of a catapult mechanism, according to an example embodiment of the present invention.
Figure 4D:
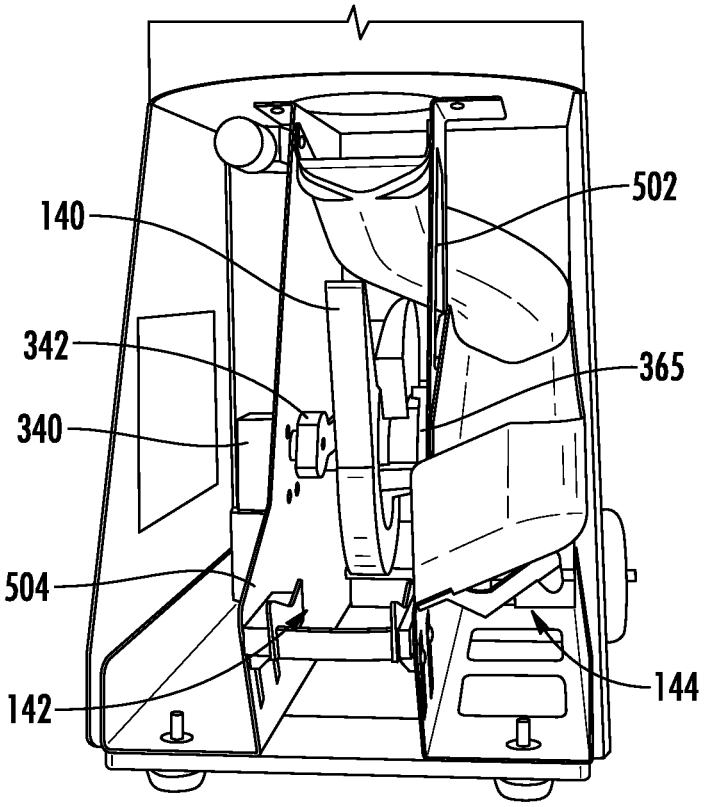
FIG. 4D is a perspective view of the catapult mechanism, according to an example embodiment of the present invention.
Figure 4E:
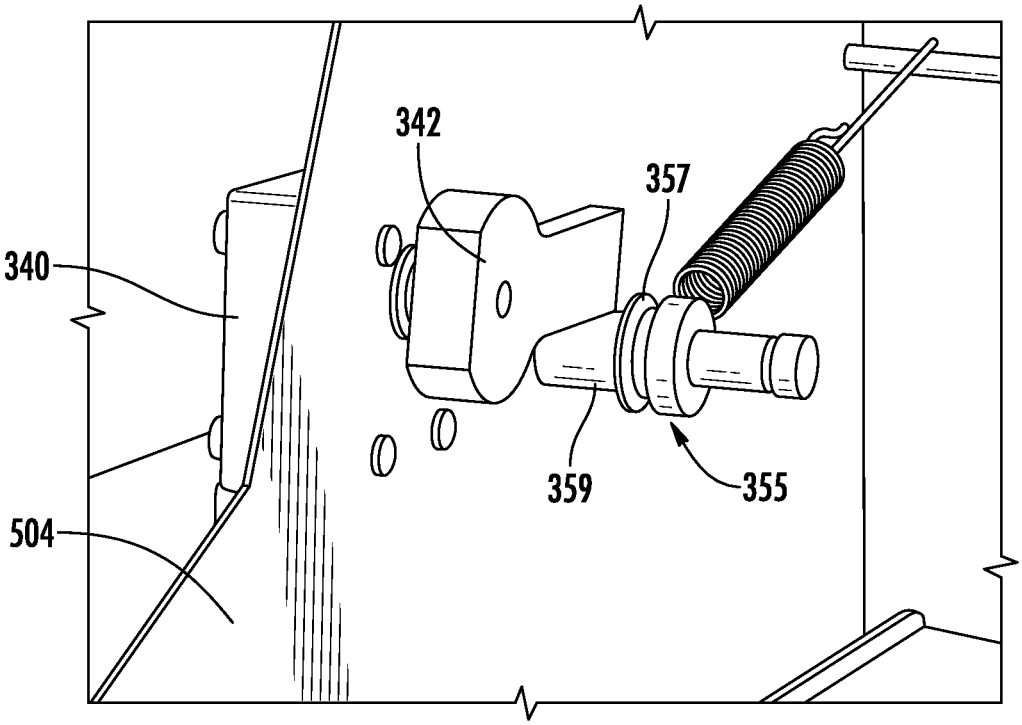
FIG. 4E is a perspective view of the motor cam engaging with the attachment features, according to an example embodiment of the present invention.

FIGS. 4C-E show example embodiments of the catapult arm 140 and related components coupled to the housing. The embodiment depicted in FIG. 4C, shows a catapult clutch 365 that includes a clutch bearing 370. In the illustration in FIG. 4C, the housing structure is not shown for illustrative purposes, however, in this embodiment, catapult arm 140 attaches to catapult clutch 365, which couples to the housing structure 502 shown in FIG. 4D. In the depicted embodiment, the clutch bearing 370 allows for one-way rotational motion, which in the depicted embodiment is clockwise when viewed at this orientation. The disclosure herein contemplates other coupling mechanisms.

FIGS. 4D and 4E show example embodiments of the catapult motor 340 coupled to the catapult arm 140 to impart rotational motion on the arm 140. FIG. 4D shows a front view of these various components. In the depicted embodiment, the device includes a catapult arm chamber 142 and a ball queue chamber 144 separated by a housing support member 502. The catapult arm 140 is located in the middle of the catapult arm chamber 142 and is coupled to the housing support member 502 via the catapult clutch 365 on one side. On the opposite side of the catapult arm, the catapult motor 340 is located behind a housing panel 504 (shown in FIG. 4E in greater detail). The catapult motor 340 connects to a motor cam 342 which is located within the catapult arm chamber 142 on the other side of the housing panel 504. In the depicted embodiment, the catapult motor 340 drives the motor cam 342 rotationally, and in this embodiment, the rotational force is clockwise at the orientation depicted in FIGS. 4C-E. In the depicted embodiments, the spring attachment feature 355 extends from the catapult arm 140 and engages with the motor cam 342. FIG. 4E shows this engagement in more detail, and in that figure, the majority of the catapult arm 140 has been removed for illustrative purposes to show the spring attachment feature 355 engaged with motor cam 342. In the depicted embodiment, motor cam 342 engages the spring attachment feature 355 by pushing it in a clockwise direction at the orientation depicted in FIGS. 4C-E. In the depicted embodiment, the motor cam 342 is not directly coupled to the spring attachment feature 355, but instead is positioned such that it is directly "behind" the spring attachment feature 355 in a clockwise rotational position. This allows the motor cam 342 to push the spring attachment feature 355, and in turn the catapult arm 140, in the clockwise direction at the orientation depicted in FIGS. 4C-E. The spring attachment feature 355 and the catapult arm 140 are free to rotate faster than the motor cam 342 in the clockwise direction at the orientation depicted in FIGS. 4C-E. In this embodiment, the motor cam 342 is not able to pull the spring attachment feature 355 or the catapult arm 140 in the counterclockwise direction at the orientation depicted in FIGS. 4C-E. Other coupling mechanisms may be used within the scope of this invention. For example, in some embodiments, the catapult motor may be directly coupled to the catapult arm at the pivot axis with a drive shaft. In other embodiments, the drive shaft may be connected to the catapult arm via gears and/or a one-way ratchet. In other embodiments, the catapult motor may be connected to the catapult arm via a belt. In still other embodiments, the catapult motor and the disk motor may be a single combined motor. In some of such embodiments, the combined motor may be connected to both the rotating disk and the catapult arm via belts, gears, and/or some other mechanism.

In some embodiments, it may be important that the catapult arm be allowed to rotate about the pivot axis independently from the rotation of the catapult motor, allowing the catapult arm some degree of rotational freedom from the catapult motor. In such embodiments, the rotation of the catapult arm about the pivot axis may be faster or slower than the rotational force provided by the catapult motor for some or all of the rotation of the catapult arm about the pivot axis. The rotational freedom may also allow the catapult arm to rotate in the reverse direction from the force provided by the catapult motor at times. Such rotational freedom may be provided in various ways. For example, as described above, the depicted embodiments allow 1-way rotational freedom. This embodiment couples the catapult arm 140 to the housing via a catapult clutch 365, which includes a clutch bearing 370. The catapult clutch bearing 370 only allows the catapult arm to rotate in one rotational direction, which in the embodiment depicted in FIG. 4C is clockwise at that orientation. In addition, the depicted embodiment further loosely couples the catapult motor 340 to the catapult arm 140 via a motor cam 342 and the spring attachment feature 355. In this embodiment, the motor cam 342 is not attached to the spring attachment feature 355, but instead is positioned to push the spring attachment feature 355 (and thus the catapult arm 140). As a result, in this embodiment, the clutch bearing 370 allows the catapult arm 140 to accelerate and rotate faster than the rotational speed of the catapult motor 340 because these components are not rigidly attached. In some embodiments, the clutch bearing 370 may slow or stop the rotational speed of the catapult arm at certain positions or speeds. For example, the clutch bearing 365 may allow the catapult arm 140 to accelerate and rotate faster than the catapult motor 340 for a portion of the rotation, e.g., 90 degrees, and after that rotation the clutch bearing 370 may stop the rotation of the catapult arm 140, allowing the motor cam 342 to reengage with the catapult arm 140. In some embodiments, the catapult arm is coupled to the housing in a manner that allows it to freely rotate and that rotation is driven (or constrained) by the coupling mechanism between the catapult arm and the catapult motor. In some embodiments, the catapult motor and related components directly provide support for the catapult arm. In some embodiments, the coupling mechanism may be a one-way ratchet that allows the catapult arm to rotate faster than the rotational force provided by the catapult motor but not slower. The catapult motor of some embodiments may also include features that allow for this rotation, such as features that allow a drive shaft to slip in a given rotational direction and/or be designed such that the rotational force of the motor can be overcome by other rotational forces provided on the catapult arm. For example, the catapult motor of some embodiments may be designed such that the rotational force provided by the catapult spring may supersede or supplement the rotational force provided by the catapult motor for all or a portion of the rotation of the catapult arm about the pivot axis. In other embodiments, the rotational force provided by the catapult motor may provide a minimum force in a given rotational direction. In such embodiments, when the rotation force provided by the catapult motor is provided in an opposite rotational direction than the force provided by the catapult spring, the catapult motor may govern the rotational direction of the catapult arm, but when the rotational force of the catapult motor is provided in the same direction as the rotational force provided by the catapult spring, the catapult spring supplements the rotational force of the catapult motor in order to rotate the catapult arm faster.

Returning to FIG. 4A, the spring attachment feature 355 of the depicted embodiment comprises a protrusion extending from the catapult arm 140 that allows one end, potentially a first end, of the catapult spring 350 to attach to the catapult arm 140. In the embodiment depicted in FIG. 4A, spring attachment feature 355 protrudes into the page. In some embodiments, the spring attachment feature may further comprise an opening in the catapult arm 140. In the depicted embodiment, as shown in FIG. 4E (which shows only the spring attachment feature and not the rest of the catapult arm), the spring attachment feature 355 is a protrusion that includes two sections, a first section 357 that attaches to one end of the catapult spring 350 and a second section 359 that engages with the motor cam 342. Some embodiments may include a separate protrusion that engages with the motor cam 342 apart from the spring attachment feature. Some embodiments may include two or more spring attachment features, which, in some of such embodiments, may be located at substantially the same radial distance from the pivot axis on the catapult arm. In other embodiments, two or more spring attachment features may be located at substantially the same circumferential location about the pivot axis on the catapult arm. Other locations, configurations, and attachment features are contemplated within the scope of this invention.

In some embodiments, the rotation of the catapult arm about the pivot axis may be controlled by a motor/spring mechanism. In the depicted embodiments, a motor/spring mechanism uses a catapult motor for a portion of the rotation and it uses the catapult spring for a portion the rotation. In some embodiments, the catapult motor may be coupled to the housing and may be connected to the catapult arm to rotate the catapult arm about the pivot axis. In some embodiments, the catapult spring of some embodiments may be attached to the catapult arm at one end, potentially a first end, at the spring attachment feature, and at an anchor position located on or coupled to the housing at a second end. In the embodiment shown in FIG. 1, the catapult spring 350 is attached at a first end to the catapult arm 140 at a rotational position that is approximately 180 degrees from the rotational position of the hammer portion 320. FIG. 1 shows that the other end of the catapult spring 350, potentially a second end, is attached to the housing 500 in a location generally opposite from the direction the ball is being tossed out of the machine. In this embodiment, the catapult spring 350 loops over a spring bar 427 proximate the second end of the catapult spring 350 attached to an anchor position 425. In this embodiment, the spring bar 427 is located above the anchor positions 425, and this configuration allows the catapult spring 350 to engage with the catapult arm 140 at a constant angle for all the anchor position 425.

Continuing with the embodiment shown in FIG. 1, the rotational forces provided by the catapult motor 340 and the catapult spring 350 will be described. In the depicted embodiment, the catapult motor 340 imparts a rotational force on the catapult arm 140 via the motor cam 342 pushing the attachment feature 355 which rotates the catapult arm 140 about the pivot axis 330 in a counter-clockwise direction when viewing the device at this orientation. (FIGS. 4C-E show the opposite side of the catapult arm 140, and thus, references to clockwise directions in relation to FIGS. 4C-E correspond to references to the counterclockwise direction in relation to FIG. 1.) In various embodiments, this rotational force may be controlled by the catapult motor and may be adjusted in a variety of ways. For example, in the embodiment depicted in FIG. 1, the catapult spring 350 is attached to the spring attachment feature 355 of the catapulting arm 140. In various embodiments, the catapult spring may provide either a clockwise rotation force or a counter-clockwise rotation force depending on the rotational location of the catapult spring and whether the catapult spring is a tension spring, a compression spring, or goes through both a compression and a tension cycle. In the embodiment depicted in FIG. 1, in which the catapult spring 350 is a tension spring, a clockwise rotation force is imparted while the spring attachment feature 355 is located below a line defined by the pivot axis 330 and the spring bar 427. In this same configuration, the force provided by the catapult spring 350 will then become a counter-clockwise force once the spring attachment feature 355 is located above that same line, i.e., the line defined by the pivot axis 330 and spring bar 427. These rotational forces can be varied in multiple ways to achieve the objects of the present invention. For example, in some embodiments, a compression spring may be used as the catapult spring, which may change the rotational force provided by that feature. In addition, in some embodiments, the location of the spring attachment feature, the anchor position and/or spring bar location, among other changes, may impact the rotational forces provided on the catapult arm as well as the rotational direction provided by the catapult spring. These changes may also impact the portion of this rotation where the catapult spring provides clockwise rotational force and the portion of this rotation where the catapult spring provides counter-clockwise rotational force.

In the embodiment depicted in FIG. 1, the catapult motor 340 provides a constant counter-clockwise rotation force on the catapult arm 140 via the motor cam 342 driving the attachment feature 355 on the catapult arm 140. At the rotational position shown in FIG. 1, in this example, the rotational force provided by the catapult spring 350 will be a clockwise force for the initial portion of the rotation of catapult arm 140 because, in this example, the catapult spring 350 is a tension spring and the spring attachment feature 355 is below a line defined by the pivot axis 330 and the spring bar 427. In the depicted embodiment, the rotational force imparted by the catapult motor 340 dominates in this position and rotates the catapult arm 140 in the counter-clockwise direction. As this rotation continues, the spring attachment feature 355 will move farther away from the anchor position 425 and the spring bar 427. Because the catapult spring 350 of the depicted embodiment is a tension spring, that movement will increase the rotational force provided by the catapult spring 350. During this portion of the rotation, where the rotational direction provided by the catapult motor 340 is in one direction and the rotational direction provided by the catapult spring 350 is in the opposite direction, the catapult motor 340 will dominate and direct the rotation of the catapult arm 140 in the counter-clockwise direction at the speed of rotation provided by the catapult motor 340. This portion of the rotation may be referred to herein as the "spring loading" rotational portion. As the catapult arm 140 continues to rotate, in the depicted embodiment, in a counter-clockwise direction, the spring attachment feature 355 will continue to move about the pivot axis 330. At some point during the rotation, the spring attachment feature 355 will be located above the line defined by the pivot axis 330 and the spring bar 427, at which point the rotational force provide by the catapult spring 350 will switch directions. At this point, the rotational force of both the catapult motor 340 and the catapult spring 350 will be provided in the same rotational direction. This point may be referred to herein as the "unloading position." In the depicted embodiment, at the unloading position, the catapult spring 350 will begin to provide rotational force in the counter-clockwise direction. This counter-clockwise rotational force will cause the catapult arm 140 to rotationally accelerate in the counter-clockwise direction. During or after the acceleration, the hammer portion 320 may contact a ball 105 located on the ball platform 410, thus tossing it out of the ball tossing device 100. The acceleration will also cause some or all of the tension created in the catapult spring 350 to be released. After this acceleration, the rotation speed of the catapult arm 140 will eventually decrease at another rotational position, and this cycle of rotation may be repeated. At each cycle, one or more balls 105 may be tossed out of the device 100.

The device of the present invention may further include various adjustable features that allow for adjustments to the tossing force provided by the catapult arm. In various embodiments, adjustments to the tossing force may alter the ball velocity and trajectory achieved by the ball tossing device. In various embodiments, these adjustment features include a spring tension adjuster and/or an adjustable position for the ball platform.

Figure 5:
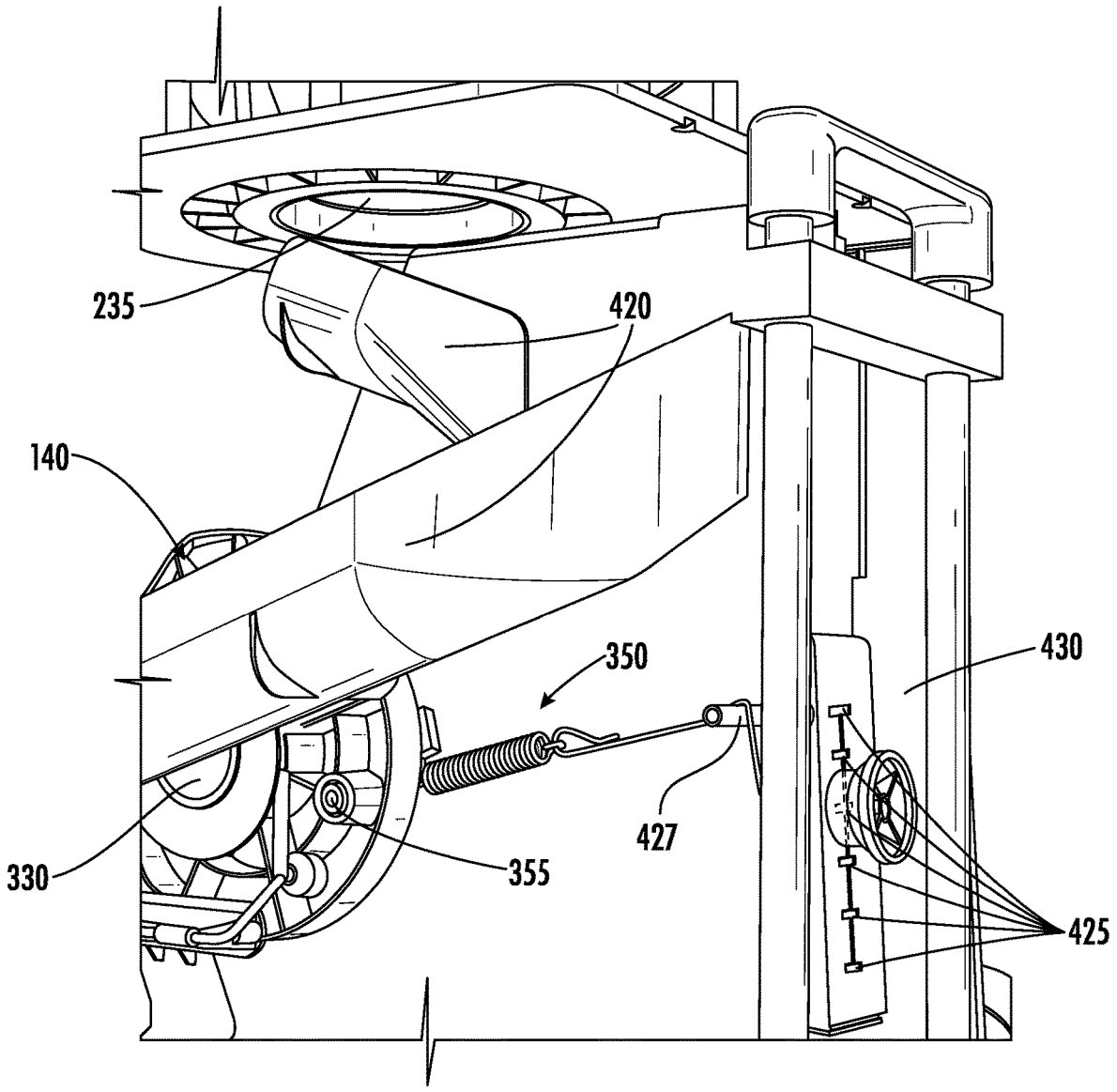
FIG. 5 is a perspective view of a catapult spring attached to a catapult arm, according to an example embodiment of the present invention.

FIG. 5 shows an example illustration of a spring tension adjuster. In the depicted embodiment, the spring tension adjuster is used to adjust the spring force provided by the catapult spring 350. As shown in FIG. 5, the device may have multiple anchor positions 425 located on or coupled to the housing 500. In the depicted embodiment, each anchor position 425 corresponds to a different spring force.

The ball tossing device 100 of the depicted embodiment also includes features that allow the spring force to be adjusted when the catapult spring 350 is coupled to a given anchor position 425. In the depicted embodiment, the spring 350 attaches to a given anchor position 425 with a spring knob 430. As discussed previously, the depicted embodiments further include the spring bar 427 connected to the housing 500. In this embodiment, the catapult spring 350 is routed over the spring bar 427, which is located above the anchor positions 425, allowing the spring tension to be changed when the spring knob 430 engages with different anchor positions 425. This configuration also allows the catapult spring 350 to engage with the catapult arm 140 at a constant angle regardless of which anchor position 425 is used. Other devices may use other mechanisms to maintain this constant angle, e.g., channels, slots, etc. In some embodiments, the spring knob 430 can be turned on an anchor position 425, and this turning will tighten or loosen the tension in catapult spring 350. In other embodiments, a lever arm and/or other features may operate similarly. In some embodiments, the second end of the catapult spring may include other engagement features (e.g., notches, protrusions, spheres, etc.). These engagement features may vary the location of the second end of the catapult spring with respect to a given anchor position. Varying the engagement feature may also vary the spring force for the catapult spring in the device. In other embodiments, the catapult spring may be switchable/replaceable in the device such that springs with different forces may be used for different applications or preferences.

In some embodiments, a visual indicator may be located at or proximate the anchor points. In such a manner, a visual indicator may provide an indication of the spring force provided when the catapult spring is coupled to a particular anchor position. In some embodiments, the visual indicator may correspond to a desired ball tossing trajectory. For example, in some embodiments, the visual indicator may correspond to a desired ball toss distance or height, e.g., short, medium, far. In other embodiments, the visual indicator may correspond to a desired ball tossing trajectory. For example, the visual indicator may correspond to a desired ball toss trajectory that is substantially the same, regardless of whether the ball being tossed is a different type of tennis ball (e.g., red, orange, green, standard) or even different types of balls (e.g, baseballs, pickleballs, softballs, tennis balls, etc.). In other embodiments, the visual indicator may come in a variety of different forms and may provide indications of other features of the device.

Figure 6A:
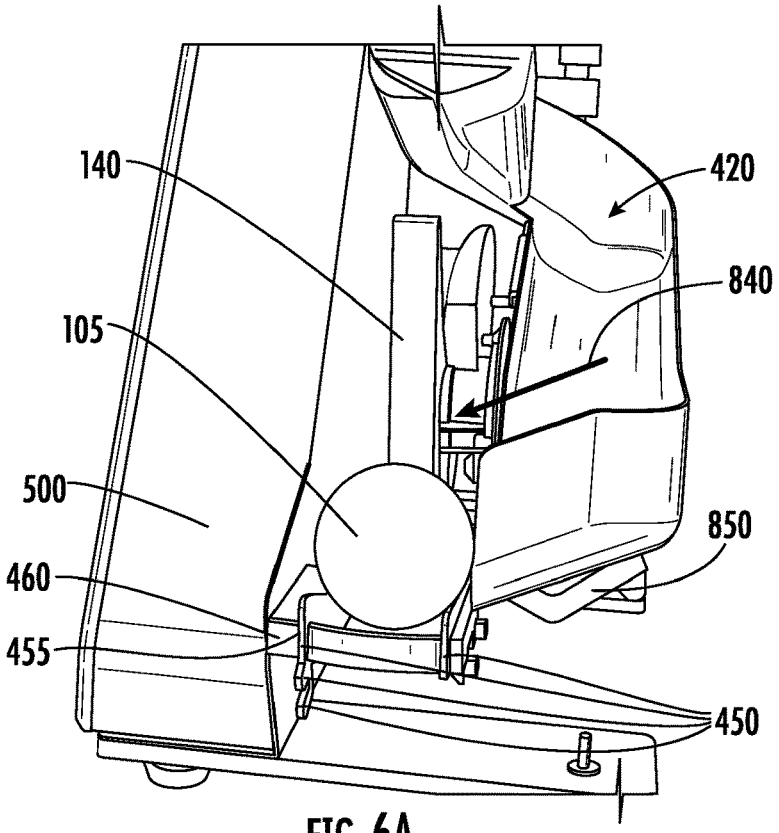
FIG. 6A is a perspective view of a ball platform coupled to a housing, according to an example embodiment of the present invention.
Figure 6B:
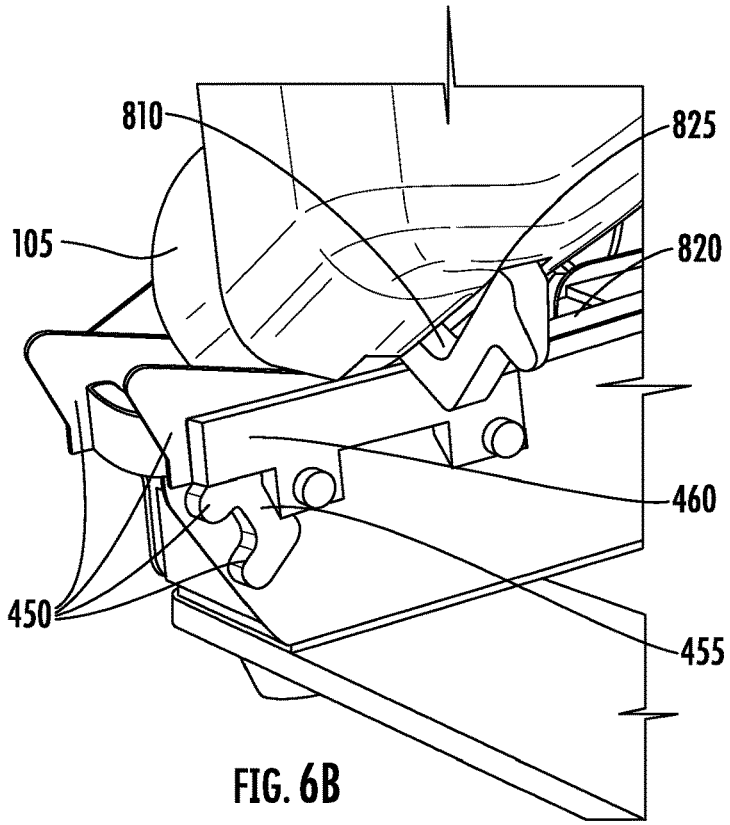
FIG. 6B is another perspective view of a ball platform coupled to a housing, according to an example embodiment of the present invention.

FIGS. 6A and 6B show example illustrations of other adjustable features of the ball tossing device, and in particular, features that adjust the position or orientation of the ball platform. In some embodiments, the ball tossing device may include a coupling feature that couples the ball platform to the housing. In the depicted embodiment, the ball tossing device 100 includes multiple coupling features 450, each of which may couple the ball platform 410 to the housing 500 and may change the position of the ball platform 410 with respect to the housing 500. In the depicted embodiment, the housing 500 includes a ball platform arm 460 that extends from the housing 500. Multiple coupling features 450 are included on the extended base portion 455, each of these coupling features 450 are capable of engaging with the ball platform arm 460. In the depicted embodiment, the ball platform arm 460 remains substantially stationary with respect to the housing 500, and the ball platform 410 location may be adjusted by adjusting which coupling feature 450 on the extended base portion 455 is supported by the ball platform arm 460.

In various embodiments, the coupling features may vary the ball platform location relative to catapult arm as well as the catapult arm path. In some embodiments, each platform location is tilted with respect to the housing. This tiling may adjust the potential ball trajectory of a ball being tossed. In other embodiments, the coupling features may raise or lower the ball platform relative to the housing or move the ball platform laterally relative the housing. This movement may adjust the relative location of the ball platform to the catapult arm and/or the catapult arm path. These and other adjustment features are contemplated by the present invention. Visual indicators may also be included at or proximate to coupling features to provide an indication of ball trajectory provided at a given ball platform location and/or orientation.

Figure 7A:
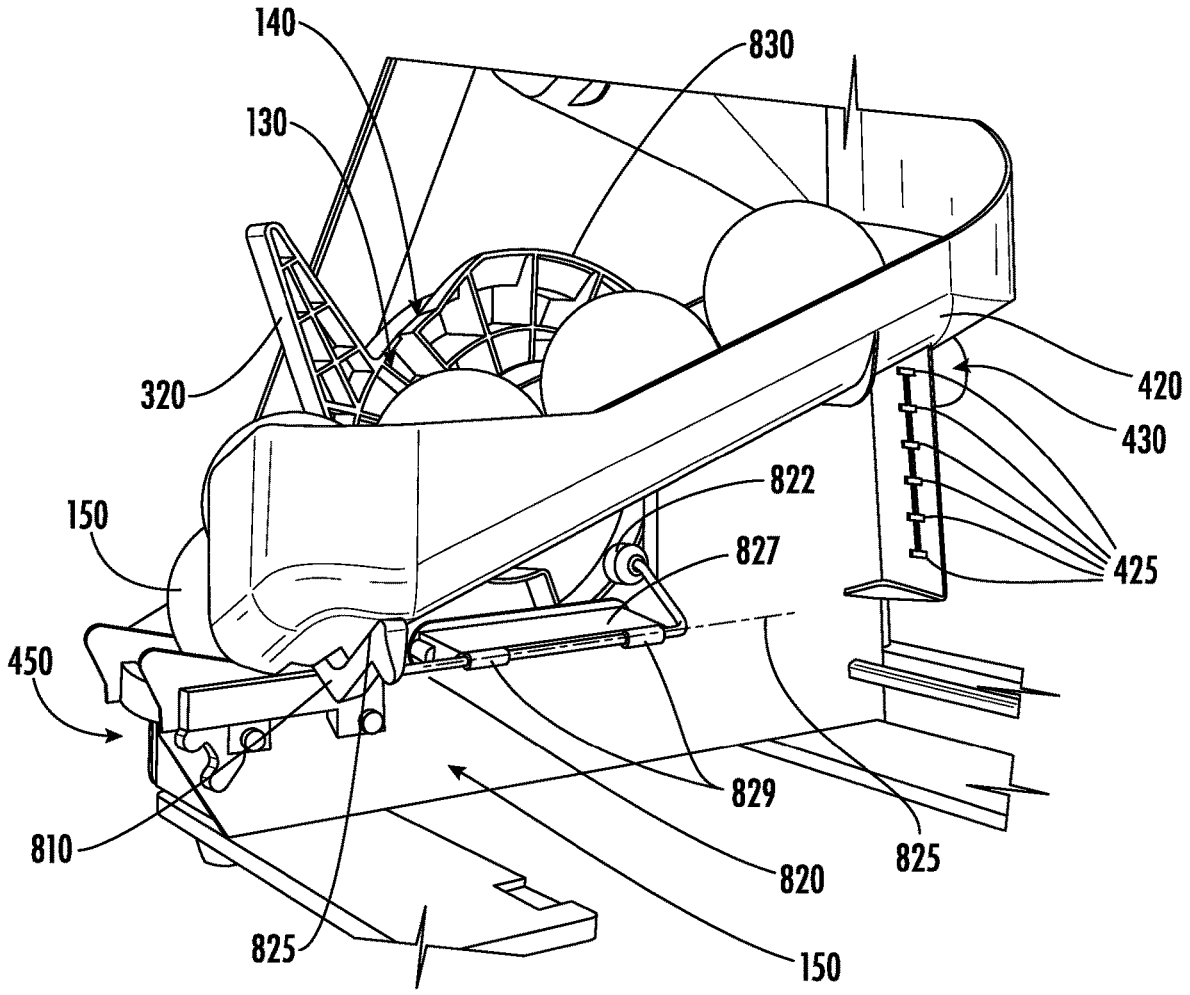
FIG. 7A is a perspective view of the indexer feature, according to an example embodiment of the present invention.
Figure 7B:
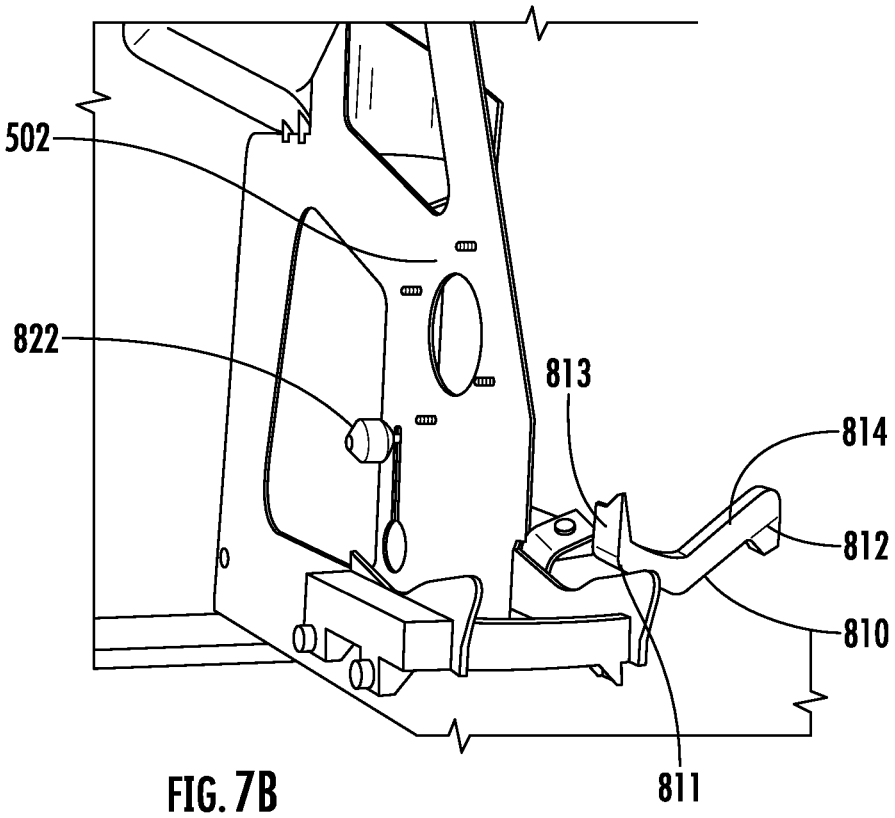
FIG. 7B is a perspective view of the indexer feature according to an example embodiment of the present invention.
Figure 7C:
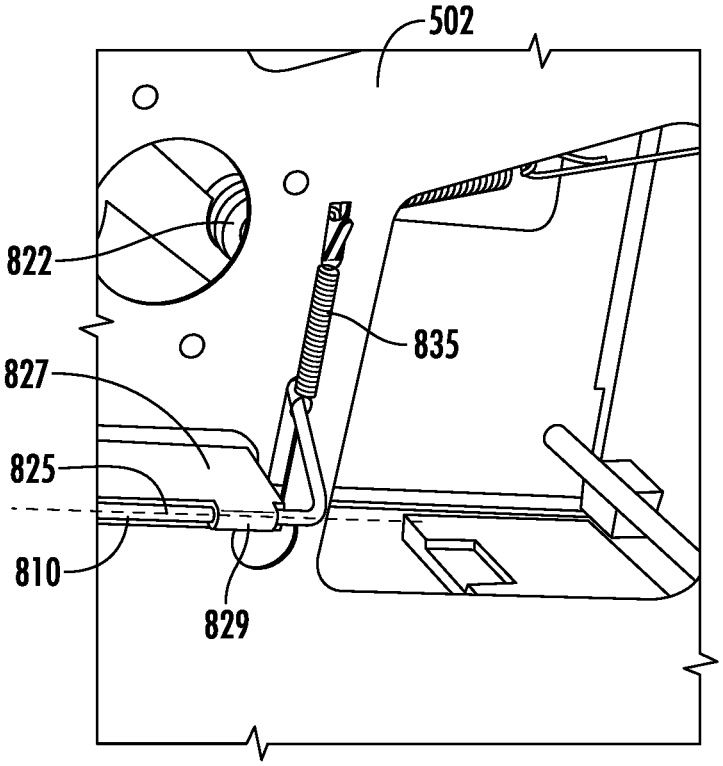
FIG. 7C is a perspective view of the indexer feature according to an example embodiment of the present invention.

FIGS. 7A-C show an example embodiment of the indexer feature 150. In some embodiments, the indexer feature may be used to isolate a ball or a series of balls in the queue from the other balls. In the depicted embodiment, the indexer feature 150 isolates the last ball in the queue from the other balls in the queue. FIG. 7A shows an illustration of the indexer feature 150 overall in the device, and in that illustration, the housing support member 502 is removed for illustrative purposes. FIG. 7B shows an illustration of the indexer tab 810 with various features removed for illustrative purposes. FIG. 7B also shows an embodiment where knob 822, discussed more below, is located within the catapult arm chamber 142. FIG. 7C shows a portion of the indexer feature where the lever arm 820 extends through the housing support member 502, and a portion of knob 822 is shown. These features and figures are discussed more in the following description.

The indexer feature 150 of the depicted embodiment comprises an indexer tab 810, a lever arm 820, an indexer pivot axis 825 defined by an indexer bracket 827, an indexer cam 830, and an indexer spring 835. In the depicted embodiment, the indexer tab 810 comprises a front end 811 and a back end 812, and moves between an actuated position and an unactuated position. In the actuated position, the front end 811 of the indexer tab 810 is moved such that a platform tab 813 on the front end 811 is located in the ball path 840 proximate the ball platform 410, isolating the last ball 105 in the queue 130. In the unactuated position, the front end 811 of the indexer tab 810 is moved to a position such that no portion of the platform tab 813 is located in the ball path 840, and thus, in this position the front end 811 of indexer tab 810 has no impact on the ball queue 130. In this unactuated position, the back end 812 of the indexer tab 810 is moved into the ball path 840 at a different location, one higher up the ball ramp 420, providing an additional buffer between the balls 105 in the queue 130 and the ball moving towards or onto the ball platform 410. In the depicted embodiment, the indexer tab 810 further includes an angled ramp 814 on the indexer tab 810. In the depicted embodiment, when the indexer tab 810 moves from the actuated position to unactuated position, the angled ramp 814 engages with the last ball in the queue while the indexer tab 810 is moving between these positions. This allows the angled ramp 814 to facilitate and, in some embodiments, guide the last ball in the queue 130 onto the lobbing platform 410 while the indexer tab 810 moves into the unactuated position. In some embodiments, the indexer tab is sized to the approximate length of the ball being tossed, such that as the front end 811 moves out of the ball path 840 the back end 812 moves into the ball path 840 at the same time at a location that is slightly behind the last ball in the queue. This configuration restrains all the balls above the last ball in approximately the same location while the indexer feature moves from the actuated position to the unactuated position. When the indexer feature moves from the unactuated position back to the actuated position, the balls in the queue are no longer constrained by the back end 812 of the indexer feature 810, and the ball queue moves down the ball ramp until stopped by the platform tab 813. In various embodiments, other features may also be used to perform this isolation in the actuated position, e.g., movable walls, depression within the ramp, offsetting the ramp, etc.

Various methods can be used to move the indexer tab between the actuated and unactuated positions. In the depicted embodiment, the indexer bracket 827 is coupled to the housing support member 502 (shown in FIG. 7C, but not shown in FIG. 7A for illustrative purposes). The indexer bracket 827 supports the lever arm 820 and allows the lever arm 820 to rotate about the indexer axis 825 using support channels 829, which define the indexer axis 825 in this embodiment. The indexer tab 810 is connected to a lever arm 820. The lever arm 820 rotates about an indexer pivot axis 825 such that when the lever arm 820 rotates about this axis, the lever arm 820 causes the indexer tab 810 to move between an actuated position and an unactuated position. In the depicted embodiment, the lever arm 820 extends from the indexer tab 810 into a position where it may engage with the indexer cam 830. FIG. 7C illustrates this portion of the lever arm 820 in this embodiment. As shown in this depicted embodiment, the indexer bracket 827 extends from a housing support member 502, which separates the catapult arm chamber 142 from the ball ramp chamber 144. In this embodiment, the lever arm 820 extends past the indexer bracket 827 and includes a bending, allowing the lever arm 820 to extend in a different direction and through an opening in the housing support member 502, and into the catapult arm chamber 142. In this embodiment, the lever arm 820 includes a knob 822 at the distal end of the lever arm 820, where the knob 822 is located within the catapult arm chamber 142. This configuration allows the indexer cam 830 on the catapult arm 140 to engage with the distal end of the lever arm 820 via the knob 822 inside the catapult arm chamber 142. In this embodiment, knob 822 is positioned and sized such that it extends in a manner that allows it to engage with the indexer cam 830 at certain rotational positions, but not any other component of the catapult arm 140. The depicted embodiment also shows the indexer spring 835 coupled on one end to the housing support member 502 and the lever arm 820 on the other. In the depicted embodiment, the indexer spring 835 biases the indexer tab 810 towards an actuated position. In particular, in this embodiment, the indexer spring 835 elevates a distal end of the lever arm 820 and knob 822 when the indexer cam 830 is not engaged with the lever arm 820. In this embodiment, this elevate position of the distal end of the lever arm 820 cause the indexer tab 810 to be positioned in the actuated position.

In the depicted embodiment, the catapult arm 140 is used to oscillate the indexer tab 810 between the actuated and unactuated positions. The catapult arm 140 includes an indexer cam 830 that extends along a portion of the outer circumference of the surface 360 as shown in FIG. 7A.

While the catapult arm 140 rotates, the indexer cam 830 rotates and eventually arrives at a rotational position where the indexer cam 830 engages the lever arm 820. When the indexer cam 830 engages with the lever arm 820 via knob 822 it pushes the distal end of the lever arm 820 down from the elevated position by overpowering the force of the indexer spring 835. This force and movement down by the distal end of the lever arm 820 rotates the lever arm 820 about the indexer pivot axis 825 causing the indexer tab 810 to move between the biased, actuated position to the unbiased, unactuated position. As the catapult arm 140 continues to rotate, the indexer cam 830 stops engaging the knob 822 at a certain rotational position, which allows the indexer spring 835 to again elevate the distal end of the lever arm 820, rotating the lever arm 820 about the indexer pivot axis 825 in the opposite direction and moving the indexer tab 810 back to the bias, actuated position. Other embodiments may have other biased positions, and may move between the biased and unbiased position in a variety of different ways.

As noted above, the structures and components depicted in the figures have been simplified for clarity and ease of explanation. For example, features may be included in some embodiments of the device that are not described above and/or not shown in the figures for ease of explanation, but which may facilitate manufacture, installation, sale, or practicability of use. In addition, many other modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Moreover, steps in the methods described above may occur in any order and are not limited to the order described above.

What is claimed is:

1. A ball tossing device comprising:

a hopper configured to hold one or more balls, the hopper comprising one or more sides and a base; and a disk located proximate the base of the hopper, the disk including an upper surface with an upper opening defined in the upper surface, a lower surface with a lower opening defined in the lower surface, and a feed channel located in the disk, the feed channel including a channel wall extending from the upper opening to the lower opening, the disk further configured to rotate about a rotation axis, wherein the upper opening, the lower opening, the feed channel, and the channel wall are configured to rotate in a fixed relationship about the rotation axis;

wherein the lower opening of the disk is substantially aligned with the rotation axis and the upper opening of the disk is offset with respect to the rotation axis, such that when the disk is rotated about the rotation axis, the upper opening rotates at a substantially fixed distance from the rotation axis and the lower opening remains in a substantially constant location relative to the rotation axis, wherein the feed channel is configured to receive at least one of the one or more balls from the hopper via the upper opening, and the channel wall is configured to route the at least one of the one or more balls from the upper opening to the lower opening through the feed channel to be tossed by the ball tossing device.

2. The ball tossing device of claim 1, wherein the disk includes an upper surface that defines a plane that is angled in relation to a plane defined by a ground.

3. The ball tossing device of claim 1, wherein the upper opening of the disk includes a scalloped portion configured to agitate the one or more balls located within the hopper when the disk is rotated about the rotation axis.

4. The ball tossing device of claim 1, wherein the disk is an elongated disk and the feed channel contains at least one bend between the upper opening and the lower opening.

5. The ball tossing device of claim 1, further comprising a disk motor configured to rotate the disk, wherein the disk motor is located a distance away from the disk.

6. The ball tossing device of claim 1, further comprising:

a platform capable of receiving one or more balls from the feed channel of the disk, wherein the platform configured to hold a ball being tossed by the ball tossing device.

7. The ball tossing device of claim 6, wherein the platform is adjustable between two or more platform positions.

8. The ball tossing device of claim 7, wherein each platform position corresponds to a desired launch position for the ball being tossed by the ball tossing device, and a visual indicator is provided proximate at least one of the one or more platform positions providing an indication of the launch position for the platform position.

9. The ball tossing device of claim 6, further comprising:

a ramp comprising an upper end and a lower end, wherein the upper end is located proximate the lower opening of the disk and is capable of receiving the at least one of the one or more balls from the feed channel, and the lower end is located proximate the platform;

a ball path defined as the path the at least one of the one or more balls travels from the upper end of the ramp to the lower end of the ramp and onto the platform; and an indexer tab proximate the lower end of the ramp, wherein the indexer tab is configured to selectively move between an actuated position, where at least a first portion of the indexer tab is located within the ball path at a first location, and an unactuated position, where a second portion of the indexer tab is located within the ball path at a second location.

10. The ball tossing device of claim 9, further comprising a lever arm configured to move the indexer tab between the actuated position and unactuated position, wherein the lever arm is configured to engage with the catapult arm when the catapult arm rotates about a pivot axis such that when the lever arm engages with the catapult arm an indexer actuator moves the indexer tab from an actuated position to an unactuated position.

11. The ball tossing device of claim 1, wherein the ball hopper comprises one or more removable panels with at least one ridge located on a lower portion of at least one of the removable panels, wherein the at least one ridge is configured to agitate the one or more balls located within the hopper when the disk is rotated about the rotation axis.

12. The ball tossing device of claim 1, further comprising:

a housing structure;

a catapult motor located in the housing structure and coupled to a catapult arm, wherein the catapult motor is configured to rotate the catapult arm about a pivot axis to strike the ball received through feed channel; and a catapult spring having a first end and a second end, wherein the first end is attached to the catapult arm at a radial distance from the pivot axis, and the second end is coupled to the housing structure at an anchor location.

13. A ball tossing machine comprising:

a housing structure;

a ball hopper coupled to the housing structure configured to hold one or more balls to be tossed;

a disk coupled to the housing structure, the disk including an upper surface with an upper opening defined in the upper surface, a lower surface with a lower opening defined in the lower surface, and a feed channel located in the disk, the feed channel including a channel wall extending from the upper opening to the lower opening, the disk further configured to rotate about a rotation axis, wherein the upper opening, the lower opening, the feed channel, and the channel wall are configured to rotate in a fixed relationship about the rotation axis; and a platform coupled to the housing structure, wherein the lower opening of the disk is substantially aligned with the rotation axis and the upper opening of the disk is offset with respect to the rotation axis, such that when the disk is rotated about the rotation axis, the upper opening rotates at a substantially fixed radius from the rotation axis and the lower opening remains in a substantially constant location, wherein the feed channel is configured to receive at least one of the one or more balls from the hopper via the upper opening, wherein the platform is configured to receive through the feed channel the at least one of the one or more balls and hold the at least one of the one or more balls prior to being tossed by the ball tossing device.

14. The ball tossing machine of claim 13, wherein the upper surface of the disk defines a plane that is angled in relation to a plane defined by a ground.

15. The ball tossing machine of claim 13, wherein the disk is an elongated disk and the feed channel opening contains at least one bend between the upper opening and the lower opening.

16. The ball tossing machine of claim 13, further comprising a disk motor configured to rotate the disk, wherein the disk motor is located a distance away from the disk, and the disk motor connects to the disk via a motor belt.

17. The ball tossing machine of claim 13, wherein the ball hopper comprises one or more removable panels with at least one ridge located on a lower portion of at least one of the removable panels, wherein the at least one ridge is configured to agitate the one or more balls located within the hopper when the disk is rotated about the rotation axis.

18. The ball tossing machine of claim 13, wherein the platform is adjustable between two or more platform positions.

19. The ball tossing machine of claim 18, further comprising:

a ramp comprising an upper end and a lower end, wherein the upper end is located proximate the lower opening of the disk and is capable of receiving a ball from the feed channel, and the lower end is located proximate the platform;

a ball path defined as the path the at least one of the one or more balls travels from the upper end of the ramp to the lower end of the ramp and onto the platform; and an indexer tab proximate the lower end of the ramp, wherein the indexer tab is configured to selectively move between an actuated position, where at least a first portion of the indexer tab is located within the ball path at a first location, and an unactuated position, where a second portion of the indexer tab is located within the ball path at a second location.

20. The ball tossing machine of claim 13, further comprising:

a catapult motor located in the housing structure and coupled to a catapult arm, wherein the catapult motor is configured to rotate the catapult arm about a pivot point to strike the at least one of the one or more balls located on the platform; and a catapult spring having a first end and a second end, wherein the first end is attached to the catapult arm at a radial distance from a pivot axis and the second end is coupled to the housing structure at an anchor position.

* * * * *